US008922610B2

(12) United States Patent
Moto et al.

(10) Patent No.: US 8,922,610 B2
(45) Date of Patent: Dec. 30, 2014

(54) THERMAL HEAD AND THERMAL PRINTER PROVIDED WITH SAME

(75) Inventors: Youichi Moto, Kirishima (JP); Hidekazu Akamatsu, Kyoto (JP); Daisaku Kato, Kirishima (JP); Naoto Matsukubo, Kirishima (JP); Akihiro Fukami, Kirishima (JP); Kouhei Nakada, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/128,590

(22) PCT Filed: Jun. 22, 2012

(86) PCT No.: PCT/JP2012/066014

§ 371 (c)(1),
(2), (4) Date: Dec. 20, 2013

(87) PCT Pub. No.: WO2012/176884

PCT Pub. Date: Dec. 27, 2012

(65) Prior Publication Data

US 2014/0132696 A1 May 15, 2014

(30) Foreign Application Priority Data

Jun. 24, 2011 (JP) ..... 2011-140788

(51) Int. Cl.
*B41J 2/335* (2006.01)
*B41J 2/345* (2006.01)

(52) U.S. Cl.
CPC ..... *B41J 2/3351* (2013.01); *B41J 2/3354* (2013.01); *B41J 2/3357* (2013.01); *B41J 2/345* (2013.01)
USPC ..... 347/201; 347/205; 347/208

(58) Field of Classification Search
USPC ..... 347/200, 201, 208, 209, 211, 205
See application file for complete search history.

(56) References Cited

U.S. PATENT DOCUMENTS 5,200,760 A * 4/1993 Ujihara et al. ..... 347/201

FOREIGN PATENT DOCUMENTS

| | | | | |
|---|---|---|---|---|
| JP | 08127144 A | | 5/1996 | |
| JP | 2001096783 A | | 4/2001 | |
| JP | 2006231703 A | | 9/2006 | |
| JP | 2006312244 A | | 11/2006 | |
| JP | 2007-055230 | * | 3/2007 | ..... B41J 2/335 |
| JP | 2007055230 A | | 3/2007 | |

OTHER PUBLICATIONS

International Search Report, PCT/JP2012/066014, Aug. 8, 2012, 2 pp.

* cited by examiner

*Primary Examiner* — Huan Tran
(74) *Attorney, Agent, or Firm* — Volpe and Koenig, P.C.

(57) ABSTRACT

A thermal head and a thermal printer are disclosed. The head includes a substrate, heat generating members, an edge portion, and first and second reinforcing members. The substrate includes: first and second surfaces opposing to each other; and an end face connecting the first and second surfaces. The heat generating members are parallel to the end face and located on the substrate. The edge portion is located on the substrate, crosses an array direction of the heating generating members, and includes first, second and third edge portions on the first main surface, the second main surface and the first end face, respectively. The first reinforcing member is located on the first, second and third edge portions. The second reinforcing member is located on the first edge portion, and separated from the first reinforcing member.

11 Claims, 14 Drawing Sheets

THERMAL HEAD AND THERMAL PRINTER PROVIDED WITH SAME

FIELD OF INVENTION

The present invention relates to a thermal head and a thermal printer provided with the thermal head.

BACKGROUND

Various types of thermal heads have been proposed as printing devices such as facsimile machines, video printers, and card printers. These thermal heads each include a plurality of heat generating members on a substrate and also include a first electrode and a second electrode that supply a voltage to each of the plurality heat generating members; a protective layer is provided so as to cover the heat generating members, first electrode, and second electrode (see PTL 1, for example).

CITATION LIST

Patent Literature

PTL 1: Japanese Unexamined Patent Application Publication No. 8-127144.

SUMMARY

Technical Problem

However, the thermal head described above has the possibility that chipping or cracking occurs at an edge portion of the substrate.

Solution to Problem

A thermal head in the present invention includes a substrate and a plurality of heat generating members provided on the substrate. The substrate includes: a first main surface; a second main surface located on a side opposite to the first main surface; and a first end face connected to the first main surface and second main surface and lying in a direction in which the plurality of heat generating members are arrayed. An edge portion is provided on each of the first main surface, first end face, and second main surface of the substrate in a direction crossing a direction in which the plurality of heat generating members are arrayed. A first reinforcing member and a second reinforcing member which is separated from the first reinforcing member are provided on the edge portion of the first main surface of the substrate. The first reinforcing member is provided at a region from on the edge portion of the first main surface of the substrate to on the edge portion of the first end face of the substrate and to on the edge portion of the second main surface of the substrate.

A thermal printer in the present invention includes: the thermal head described above; a conveying mechanism that conveys a recoding medium on the heat generating members; and a platen roller that presses the recording medium against the heat generating members.

Advantageous Effects of Invention

The present invention can reduce the possibility that chipping or cracking occurs in an edge portion of the substrate.

DETAILED DESCRIPTION OF THE PREFERRED EMBODIMENTS

First Embodiment

A first embodiment of the thermal head in the present invention will be described below with reference to the drawings.

As illustrated in FIGS. 1 to 5, the heat dissipating body 1 includes a base 1*a*, which is like a plate with a rectangular shape in a plan view, and a protrusion 1*b*, which is placed on the upper surface of the base 1*a* and extends along a longer edge portion of the base 1*a*. The heat dissipating body 1 may have only the base 1*a*. The heat dissipating body 1 is formed with a metal material of, for example, copper or aluminum, and has a function of dissipating part of heat that is generated by heat generating members 9 on the head base substrate 3 but does not contribute to printing as described later.

Figure 1:
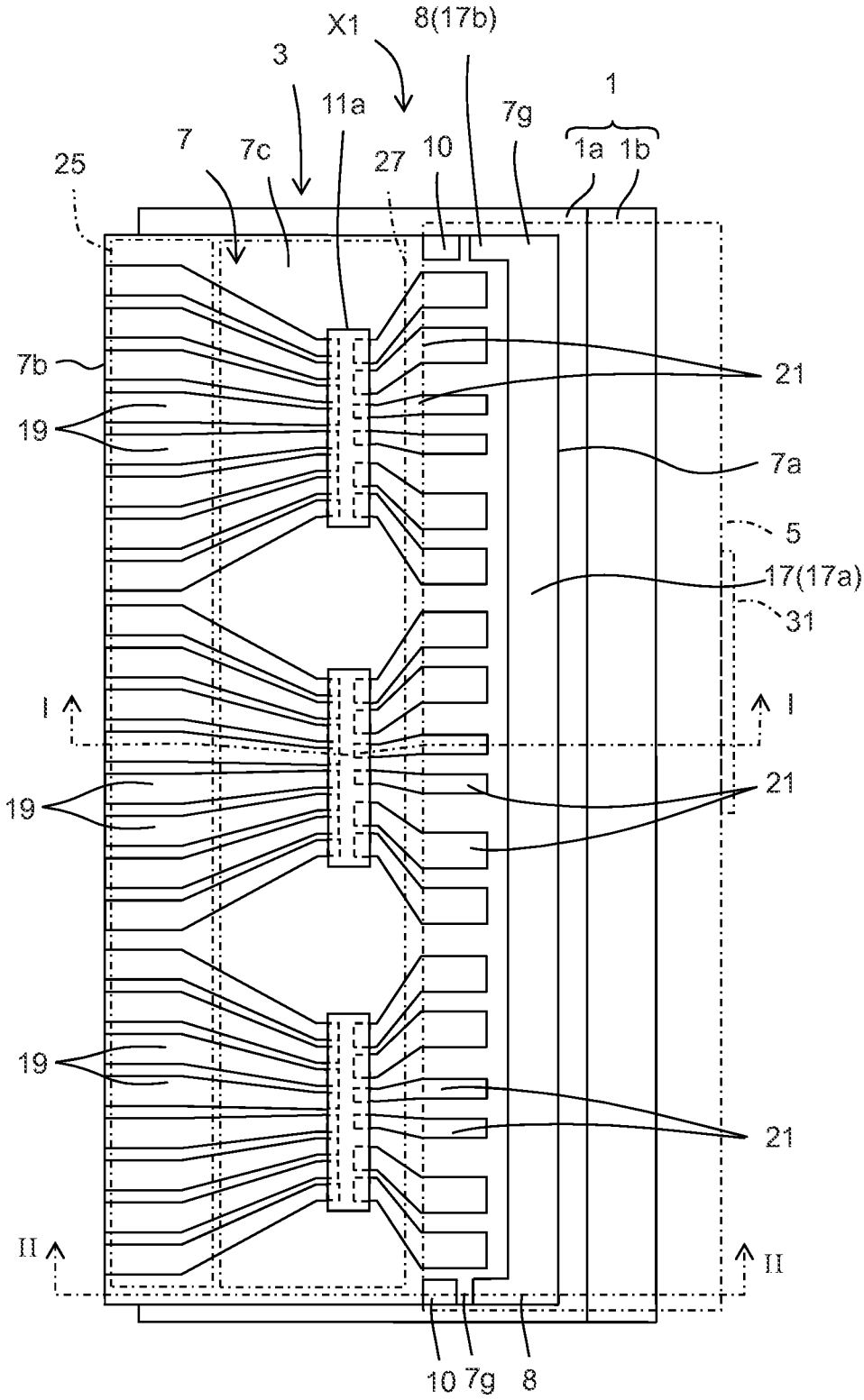
FIG. 1 is a plan view illustrating a thermal head according to an embodiment of the present invention.
Figure 2:
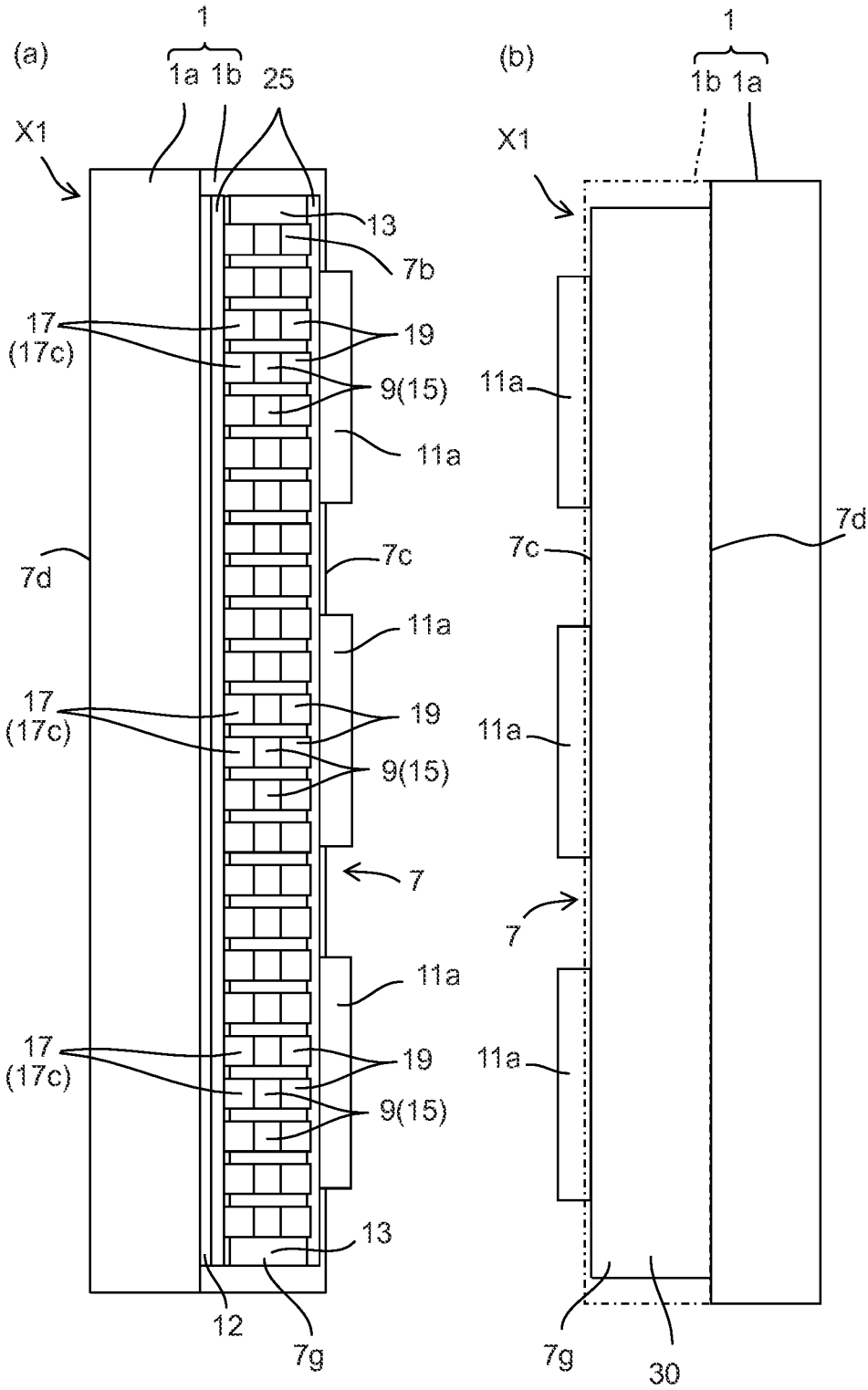
FIG. 2(*a*) is a left side view of the thermal head in FIG. 1, and FIG. 2(*b*) is a right side view of the thermal head in FIG. 1.

As illustrated in FIGS. 1 and 2, the head base substrate 3 includes a substrate 7 with a rectangular shape in a plan view, a plurality of heat generating members 9 arrayed along the longitudinal direction of the substrate 7, and a plurality of driving ICs 11*a*, which are control parts placed side by side on a first main surface 7*c* of the substrate 7 along the array direction of the heat generating members 9.

The substrate 7 has a first end face 7*a*, a second end face 7*b*, the first main surface 7*c*, and a second main surface 7*d*. The first end face 7*a* is linked to the first main surface 7*c* and second main surface 7*d* and extends in the array direction of the plurality of heat generating members 9. The second end face 7*b* is located on the side opposite to the first end face 7*a*. On the second end face 7*b*, the plurality of heat generating members 9 are placed in a line. The first main surface 7*c*, first end face 7*a*, and second main surface 7*d* each has an edge portion 7*g* in a direction crossing the array direction of the plurality of heat generating members 9. The second main surface 7*d* is located on the side opposite to the first main surface 7*c*. The edge portion 7*g* is an area near end faces orthogonal to the array direction of the heat generating members 9; the area occupies up to 20% of the length of the substrate 7 from each end face of the substrate 7. If, for example, the length of the substrate 7 is 30 mm, an area with a length of 6 mm between the end faces orthogonal to the array direction of the heat generating members 9 is the edge portion 7*g*.

The substrate 7 is formed with, for example, an electrically insulating material such as alumina ceramics or a semiconductor material such as monocrystal silicon.

The head base substrate 3 is formed by placing, on the substrate 7, the heat generating members 9, driving ICs 11*a*, or another member that drives the thermal head X1. The head base substrate 3 is placed on the upper surface of the base 1*a* of the heat dissipating body 1, and the first end face 7*a* of the substrate 7 is disposed facing the protrusion 1*b* of the heat dissipating body 1. The lower surface of the head base substrate 3, more specifically, the lower surface of a third protective layer 29 described later, and the upper surface of the base 1*a* are mutually bonded with a double-sided adhesive tape (not illustrated), retaining the head base substrate 3 on the base 1*a*.

Figure 4:
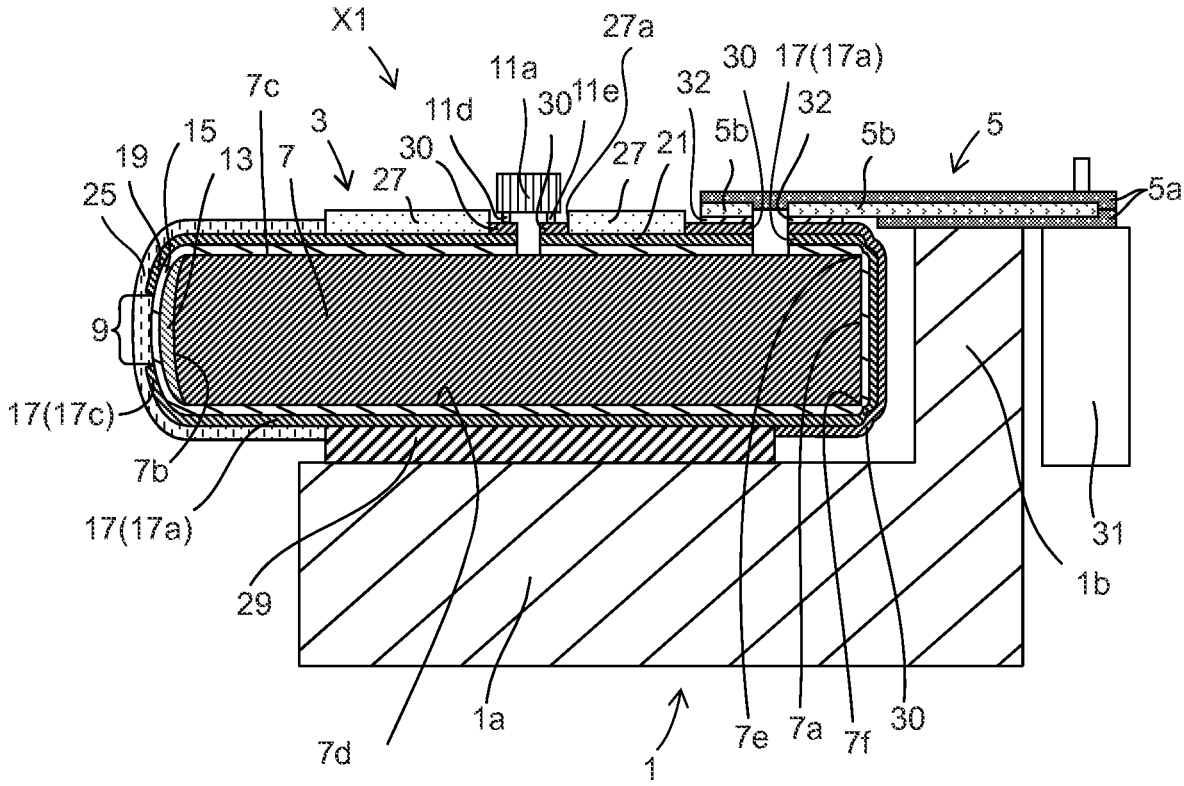
FIG. 4 is a cross sectional view of the thermal head in FIG. 1, taken along line I-I.
Figure 5:
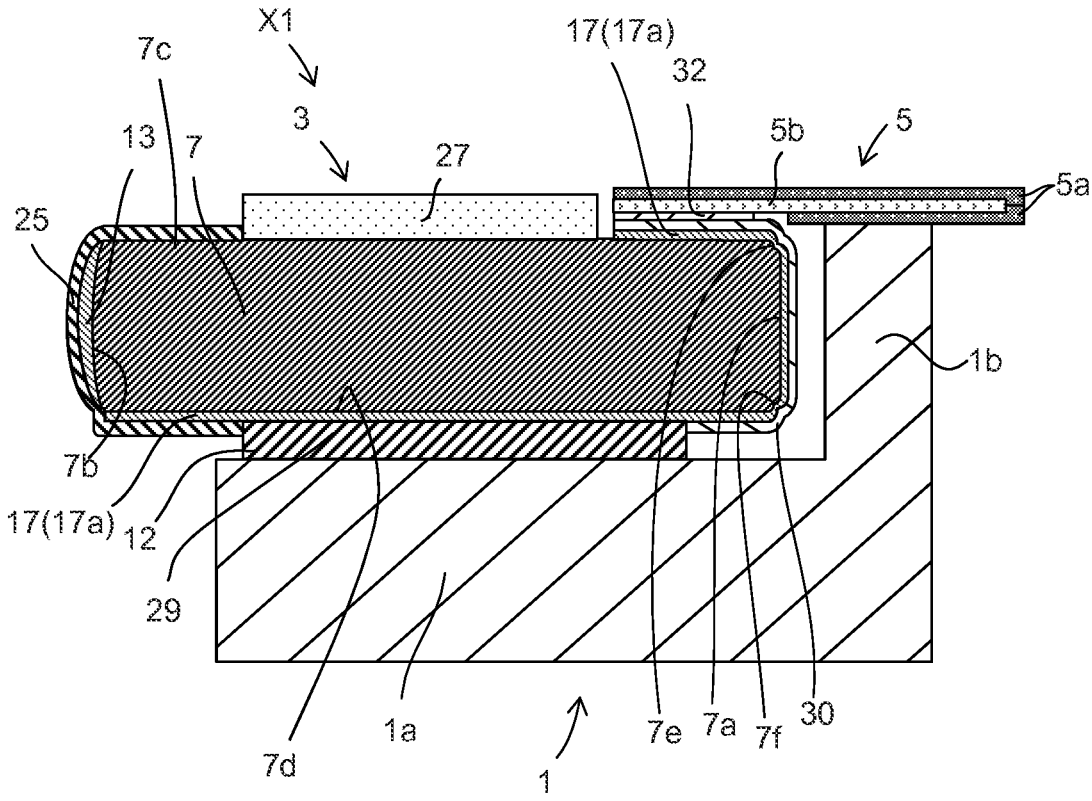
FIG. 5 is a cross sectional view of the thermal head in FIG. 1, taken along line II-II.

As illustrated in FIGS. 4 and 5, a heat storage layer 13 is formed on the second end face 7*b* of the substrate 7. The second end face 7*b* of the substrate 7 has a convex curved surface in a cross sectional view, and the heat storage layer 13 is formed on the second end face 7*b*. Therefore, the surface of the heat storage layer 13 is also curved. The heat storage layer 13 functions so as to preferably press a recording medium (not illustrated), on which printing is to be performed, against a first protective layer 25 (described later), which is formed on the heat generating members 9.

The heat storage layer 13 is formed with, for example, glass with low thermal conductivity. The heat storage layer 13 functions so that a time taken to raise the temperature of the heat generating members 9 is shortened by temporarily storing part of heat generated by the heat generating members 9 and the heat response characteristics of the thermal head X1 is thereby improved. In this embodiment, as illustrated in FIG. 2, the heat storage layer 13 is formed only on the second end face 7*b* of the substrate 7, so heat can be stored in the vicinity of the heat generating part 9, enabling the heat response characteristics of the thermal head X1 to be more efficiently improved.

The heat storage layer 13 is formed by, for example, applying prescribed glass paste obtained by mixing glass powder with an appropriate organic solvent to the second end face 7*b* of the substrate 7 by conventional known screen printing or another method and then firing the applied glass paste.

As described in FIG. 4, an electrical resistance layer 15 is formed on the first main surface 7*c* of the substrate 7, the heat storage layer 13, and the second main surface 7*d* and second end face 7*b* of the substrate 7. The electrical resistance layer 15 is disposed between the substrate 7 and individual electrodes 19, between the substrate 7 and a common electrode 17, between the heat storage layer 13 and the individual electrodes 19, and between the heat storage layer 13 and the common electrode 17. IC-FPC connection electrodes 21 are provided on the first main surface 7*c*.

An area for the electrical resistance layer 15 on the first main surface 7*c* of the substrate 7 is formed so as to have the same shape as the common electrode 17, individual electrode 19, and IC-FPC connection electrodes 21 in a plan view, as illustrated in FIG. 1.

An area for the electrical resistance layer 15 on the heat storage layer 13 includes an area formed so as to have the same shape as the common electrode 17 and individual electrode 19 and a plurality of areas exposed between the common electrode 17 and the individual electrodes 19 (these areas will be referred to below as the exposed areas) in a side view, as illustrated in FIG. 2.

An area for the electrical resistance layer 15 on the second main surface 7*d* of the substrate 7 is formed so as to cover the entire second main surface 7*d* of the substrate 7 and have the same shape as the common electrode 17, as illustrated in FIGS. 4 and 5.

Since the areas of the electrical resistance layer 15 are formed as described above, the electrical resistance layer 15 is hidden below the common electrode 17 in FIG. 1, individual electrodes 19, and IC-FPC connection electrodes 21 and is not illustrated. In FIG. 2, the electrical resistance layer 15 is hidden below the common electrode 17 and individual electrodes 19, and only the exposed areas are illustrated.

When a voltage is applied to each exposed area of the electrical resistance layer 15, the exposed area generates heat, forming the heat generating part 9 described above. The plurality of exposed areas are placed on the heat storage layer 13 in a line as illustrated in FIG. 2. Although the plurality of heat generating members 9 are simplified for convenience of explanation in FIG. 2, they are allocated at a density of, for example, 180 dpi to 2400 dpi.

The electrical resistance layer 15 is formed with, for example, a material having relatively high electric resistance such as a TaN-, TaSiO-, TaSiNO-, TiSiO-, TiSiCO-, or NbSiO-based material. When a voltage is applied across the common electrode 17 and individual electrode 19, which will be descried later, and a current is supplied to the heat generating part 9, therefore, the heat generating part 9 generates heat due to Joule heat generation.

As illustrated in FIGS. 1 to 5, the common electrode 17, the plurality of individual electrodes 19, and the plurality of IC-FPC connection electrodes 21 are disposed on the electrical resistance layer 15. These common electrode 17, individual electrode 19, and IC-FPC connection electrodes 21 are formed with a material having conductivity such as, for example, any one of metals of aluminum, gold, silver, and copper or their alloys.

These electrodes will be described below in detail with reference to FIGS. 1 to 5.

Figure 3:
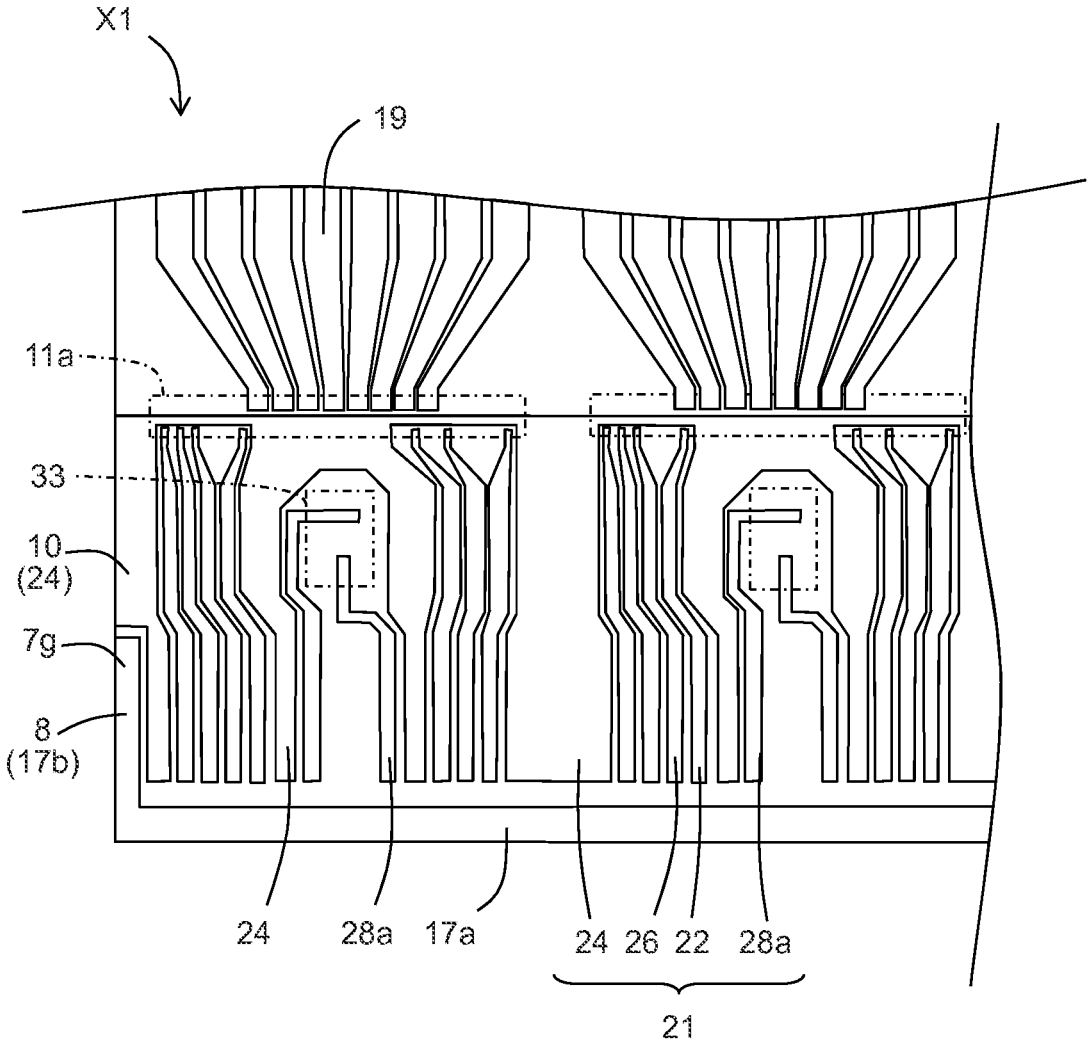
FIG. 3 is a plan view illustrating an enlarged view of an edge portion of a substrate in a direction in which heat generating members in the thermal head in FIG. 1 are arrayed.

The plurality of individual electrodes 19 are used to connect the heat generating members 9 and driving ICs 11*a*. As illustrated in FIGS. 1 to 3, each individual electrode 19, one end of which is connected to the heat generating part 9, individually extends like a band from the second end face 7*b* of the substrate 7 over the first main surface 7*c* of the substrate 7.

Another end of each individual electrode 19 is placed in the placement area of the driving IC 11*a*. When the other end of the individual electrode 19 is connected to the driving IC 11*a*, each heat generating part 9 and the relevant driving IC 11*a* are electrically connected. To be more specific, the plurality of heat generating members 9 are divided into a plurality of groups, and individual electrodes 19 electrically connects heat generating members 9 in each group to one driving ICs 11*a* provided in correspondence to the group.

The plurality of IC-FPC connection electrodes 21, which are used to connect the driving ICs 11*a* and FPC 5, are formed so as to send electric signals to the driving ICs 11*a*. As illustrated in FIGS. 1 and 3, each IC-FPC connection electrode 21 extends like a band on the first main surface 7*c* of the substrate 7. One end of the IC-FPC connection electrode 21 is placed in the placement area of the driving IC 11*a*, and another end is placed in the vicinity of an extending portion 17*a* of the common electrode 17 described later, the extending portion 17*a* being on the first main surface 7*c* of the substrate 7. One end of each of the plurality of IC-FPC connection electrodes 21 is connected to the driving IC 11*a*, and another end is connected to the FPC 5, electrically connecting the driving IC 11*a* and FPC 5. The IC-FPC connection electrode 21 is a second electrode in the present invention.

To be more specific, the plurality of IC-FPC connection electrodes 21 connected to one driving IC 11*a* are formed with a plurality of electrodes having different functions. Specifically, the plurality of IC-FPC connection electrodes 21 include an IC electrode 22, a ground electrode 24, an IC control electrode 26, a temperature measuring electrode 28*a*, and the like. The IC electrode 22 applies a voltage used to operate the driving IC 11*a*. The ground electrode 24 maintains the driving IC 11*a* and the individual electrode 19 connected to the driving IC 11*a* at a ground potential of, for example 0 to 1 V. The IC control electrode 26 supplies an electric signal that operates the driving IC 11*a* so that it controls the turned-on and turned-off states of switching elements in the driving IC 11*a*. The temperature measuring electrode 28*a* supplies a temperature measured by a temperature measuring member 33 to the outside as a signal As illustrated in FIGS. 1 and 2, the driving IC 11*a* is placed in correspondence to one group of a plurality of heat generating members 9 and is connected to the other ends of the individual electrodes 19 and to the one ends of the IC-FPC connection electrodes 21. The driving IC 11*a* controls the current-carrying state of each heat generating part 9, so the driving IC 11*a* internally includes a plurality of switching elements. As the driving IC 11*a*, a known driving IC can be used that is placed in the current-carrying state when each switching element is turned on and is placed in a non-current-carrying state when each switching element is turned off. Although the driving IC 11*a* has been exemplified as the control unit, the control unit is not limited to a driving IC; the control unit is only needs to be able to control the current-carrying state of the heat generating part 9.

Each driving IC 11*a* internally includes a plurality of switching elements (not illustrated) so as to correspond to the individual electrodes 19 connected to the driving IC 11*a*. As illustrated in FIG. 4, in each driving IC 11*a*, a connection terminal 11*d* (referred to below as the first connection terminal 11*d*) connected to each switching element is connected to the individual electrode 19, and another connection terminal 11*e* (referred to below as the second connection terminal 11*e*) connected to the switching element is connected to the above ground electrode 24 of the IC-FPC connection electrodes 21. To be more specific, the first connection terminal 11*d* and second connection terminal 11*e* of the driving IC 11*a* are bonded onto a covering layer 30 (described later), which is formed on the individual electrode 19 and IC-FPC connection electrode 21, by using solder (not illustrated). Thus, while each switching element in the driving IC 11*a* is placed in the turned-on state, the individual electrode 19 connected to the switching element and the ground electrode 24 of the IC-FPC connection electrodes 21 are electrically connected.

The common electrode 17 connects the plurality of heat generating members 9 and the FPC 5. As illustrated in FIGS. 1, 3, and 4, the common electrode 17 includes the extending portion 17*a*, a protrusion 17*b* protruding from the extending portion 17*a*, and a lead part 17*c*. The extending portion 17*a* is formed over the entire surface of the second main surface 7*d* and first end face 7*a* of the substrate 7 and extends along the first end face 7*a* on the first main surface 7*c* of the substrate 7.

Since the common electrode 17 is formed over substantially the entire area of the second main surface 7*d* and first end face 7*a* of the substrate 7 as described above, the area of the common electrode 17 can be enlarged and the wiring resistance of the common electrode 17 can be thereby reduced. When the area of the common electrode 17 is enlarged, the current capacity of the common electrode 17 can be increased.

The protrusion 17*b* is formed on the first main surface 7*c* of the substrate 7 so as to protrude from the extending portion 17*a* at the edge portion 7*g* of the substrate 7. The lead part 17*c* individually extends from the extending portion 17*a* on the second main surface 7*d* of the substrate 7 toward the relevant heat generating part 9. The end of each lead part 17*c* faces one end of the individual electrode 19 with the relevant heat generating part 9 interposed therebetween.

As described above, one end of the common electrode 17 is connected to the heat generating members 9 on the first end face 7*a* of the substrate 7. The common electrode 17 is disposed so as to extend from on the first end face 7*a* of the substrate 7 through on the second main surface 7*d* and second end face 7*b* onto the first main surface 7*c*. Another end of the common electrode 17 is placed at one end of the first main surface 7*c*. The common electrode 17 is a first electrode in the present invention.

When the extending portion 17*a* on the first main surface 7*c* of the substrate 7 and the protrusion 17*b* at the end of the common electrode 17 are connected to the FPC 5 as illustrated in FIGS. 1, 3, and 4, the common electrode 17 electrically connects each heat generating part 9 to the FPC 5.

The above electrical resistance layer 15, common electrode 17, individual electrodes 19, and IC-FPC connection electrodes 21 are formed by, for example, sequentially laminating material layers that form them on the substrate 7 on which the heat storage layer 13 has been formed by a conventionally known thin-film forming method such as a sputtering method and then machining the laminated body to a prescribed pattern by conventionally known photo-etching or the like. In this embodiment, the common electrode 17, individual electrodes 19, and IC-FPC connection electrodes 21 can be concurrently formed in the same process. It is also possible that the electrical resistance layer 15 has a thickness of, for example, 0.01 μm to 0.2 μm and the common electrode 17, individual electrode 19, and IC-FPC connection electrode 21 have a thickness of, for example, 0.05 μm to 2.5 μm.

The pattern of each electrode formed on the first main surface 7*c* of the substrate 7 will be described with reference to FIG. 3. In FIG. 3, the driving IC 11*a* is omitted; instead, the position at which to mount the driving IC 11*a* and the position at which to mount the temperature measuring member 33 are indicated by dash-dot lines. The terminals to which the driving IC 11*a* is connected are also omitted.

As illustrated in FIG. 3, the protrusion 17*b* of the common electrode 17 is disposed on the edge portion 7*g* of the first main surface 7*c* of the substrate 7. This protrusion 17*b* functions as a first reinforcing member 8. That is, the first reinforcing member 8 is formed by part of the common electrode 17. When the common electrode 17 is formed on the first main surface 7*c* of the substrate 7, therefore, the first reinforcing member 8 can also be formed together. That is, there is no need to provide the first reinforcing member 8 separately in a separate manufacturing process, enabling the thermal head X1 with the first reinforcing member 8 to be easily manufactured.

The first reinforcing member 8 includes the common electrode 17 disposed on the edge portion 7*g* of the first main surface 7*c*, the common electrode 17 disposed on the edge portion 7*g* of the first end face 7*a*, and the common electrode 17 disposed on the edge portion 7*g* of the second main surface 7*d*. That is, the first reinforcing member 8 is disposed throughout on the first main surface 7*c*, first end face 7*a*, and second main surface 7*d* of the substrate 7.

With the thermal head X1, therefore, it is possible to reduce the possibility that chipping or cracking occurs in the edge portion 7*g* of the substrate 7. Accordingly, the reliability of the thermal head X1 can be improved. Even in a case in which a plurality of thermal heads X1 are manufactured from a substrate targeted at thermal heads by dividing the substrate, it is possible to reduce the possibility that chipping or cracking occurs in the edge portion 7*g* of the thermal head X1.

Furthermore, if the first reinforcing member 8 is formed as part of the common electrode 17, when the common electrode 17 is provided in an integrated manner, the first reinforcing member 8 is formed from on the first main surface 7*c* of the substrate 7 onto its first end face 7*a* and second main surface 7*d*. Accordingly, the edge portion 7*g* of the substrate 7 can be further reinforced, so it is possible to reduce the possibility that chipping or cracking occurs.

With the thermal head X1, the ground electrode 24 is disposed on the edge portion 7*g* of the first main surface 7*c*, so the ground electrode 24 on the edge portion 7*g* of the first main surface 7*c* functions as a second reinforcing member 10. That is, the second reinforcing member 10 is formed by part of the ground electrode 24. When the ground electrode 24 is provided on the first main surface 7*c* of the substrate 7, therefore, the second reinforcing member 10 can also be formed together.

The second reinforcing member 10 is disposed at a distance from the first reinforcing member 8. Even if the first reinforcing member 8 is thermally expands due to heat generated at the time of driving the thermal head X1, it is possible to reduce the possibility that stress is generated in the second reinforcing member 10 due to the thermal expansion of the first reinforcing member 8 and the substrate 7 is thereby separated from the second reinforcing member 10 because there is a space between the first reinforcing member 8 and the second reinforcing member 10.

With the thermal head X1, since the first reinforcing member 8 and second reinforcing member 10 are provided on the edge portion 7*g* of the substrate 7, it is possible to reduce the possibility that chipping or cracking occurs in the edge portion 7*g* of the substrate 7. Accordingly, the reliability of the thermal head X1 can be improved. Even in a case in which a plurality of thermal heads X1 are manufactured from a substrate targeted at thermal heads by dividing the substrate, it is possible to reduce the possibility that chipping or cracking occurs in the edge of the substrate 7.

With the thermal head X1, the ground electrode 24 is disposed so as to enclose the IC electrode 22 and IC control electrode 26. Therefore, even if signals with a high frequency are supplied to the IC electrode 22 and IC control electrode 26, high frequencies generated by the IC electrode 22 and IC control electrode 26 can be blocked, so various parts included in the thermal head X1 can be protected from the high frequencies.

Since the ground electrode 24 is disposed so as to enclose the temperature measuring electrode 28*a*, the temperature measuring electrode 28*a* can be protected from high frequencies generated by the IC electrode 22 and IC control electrode 26. Therefore, temperature sensed by the temperature measuring member 33 can be accurately reported.

With the thermal head X1, since the heat generating part 9 is disposed on the second end face 7*b* and the common electrode 17 extends from on the edge portion 7*g* of the first main surface 7*c* of the substrate 7 onto the first end face 7*a* and second main surface 7*d* of the substrate 7, an area of the heat generating part 9 that comes into contact with a recording medium can be expanded and the electric capacity of the common electrode 17 can be increased.

The temperature measuring member 33 disposed on the temperature measuring electrode 28*a* is provided to measure the temperature of the thermal head X1. To control the thermal head X1, the driving IC 11*a* is controlled according to the temperature measured by the temperature measuring member 33. Thus, the temperature of the thermal head X1 can be precisely measured by providing the temperature measuring member 33 on the first main surface 7*c* of the substrate 7. A member having a function of measuring temperature can be used as the temperature measuring member 33; for example, a thermocouple, a chip thermistor, or another member can be used.

As illustrated in FIGS. 1 to 5, the first protective layer 25, which covers the heat generating members 9, part of the common electrode 17, and part of the individual electrodes 19, is formed on the heat storage layer 13 and the first main surface 7*c* and second main surface 7*d* of the substrate 7. The first protective layer 25 is disposed so as to cover the whole of the heat storage layer 13 and, on the second main surface 7*d* of the substrate 7, to cover an area corresponding to the first main surface 7*c* of the substrate 7.

The first protective layer 25 protects the covered areas of the heat generating members 9, common electrode 17, and individual electrodes 19 from corrosion due to adhesion of moisture or the like included in the atmosphere or from abrasion due to contact with a recording medium on which printing is to be performed. The first protective layer 25 can be formed with, for example, an SiC-, SiN-, SiO, or SiON-based material. The first protective layer 25 can be formed by using, for example, a conventionally known thin-film forming method such as a sputtering method or a deposition method or a thick-film forming technology such as a screen printing method. Alternatively, the first protective layer 25 may be formed by laminating a plurality of material layers.

Although the first protective layer 25 is likely to generate a step on its surface due to a difference between the surfaces of the common electrode 17 and individual electrode 19 and the surface of the heat generating part 9, if the thicknesses of the common electrode 17 and individual electrode 19 are reduced to, for example, 0.2 μm or less, it is possible to eliminate or reduce a step formed on the surface of the first protective layer 25.

As illustrated in FIGS. 1, 4, and 5, a second protective layer 27, which partially covers the individual electrodes 19 and IC-FPC connection electrodes 21, is formed on the first main surface 7*c* of the substrate 7. For convenience of explanation, the second protective layer 27 is omitted in FIG. 1; instead, an area in which to form the second protective layer 27 is indicated by dash-dot lines.

The second protective layer 27 protects the covered areas of the individual electrodes 19 and IC-FPC connection electrodes 21 from oxidation due to contact with the atmosphere or from corrosion due to adhesion of moisture or the like included in the atmosphere. The second protective layer 27 can be formed with, for example, a resin material such as an epoxy resin or a polyimide resin. The second protective layer 27 can be formed by using, for example, a thick-film forming technology such as a screen printing method.

As illustrated in FIG. 1, the ends, connected to the FPC 5, of the IC-FPC connection electrodes 21 are exposed from the second protective layer 27, and an exposed area and substrate 7 are connected.

The second protective layer 27 has an opening 27*a* (see FIG. 4) so that the ends of each individual electrode 19 and IC-FPC connection electrode 21, which are connected to the driving IC 11*a*, are exposed. The individual electrode 19 and IC-FPC connection electrode 21 are connected through the opening 27*a* to the driving IC 11*a*.

To be more specific, the covering layer 30, described later, is formed on the ends of the individual electrode 19 and IC-FPC connection electrodes 21 exposed from the opening 27*a*, and these electrodes are bonded to the driving IC 11*a* by soldering with the covering layer 30 interposed therebetween as described above. Thus, intensity with which the driving IC 11*a* is connected onto the individual electrodes 19 and IC-FPC connection electrodes 21 can be increased by bonding the driving IC 11*a* onto the covering layer 30, which is formed by plating, by soldering.

The driving IC 11*a* is sealed by being covered by a covering member (not illustrated) formed with an epoxy resin, a silicon resin, or another resin to protect the driving IC 11*a* itself, and a connected parts between the driving IC 11*a* and the individual electrodes 19 and between the driving IC 11*a* and the IC-FPC connection electrodes 21 in a state in which the driving IC 11*a* is connected to the individual electrodes 19 and IC-FPC connection electrodes 21.

As illustrated in FIGS. 4 and 5, the third protective layer 29, which partially covers the common electrode 17, is provided on the second main surface 7*d* of the substrate 7. The third protective layer 29 is disposed so as to partially cover an area, on the second main surface 7*d* of the substrate 7, to the right of the first protective layer 25.

The third protective layer 29 protects the covered areas of the common electrode 17 from oxidation due to contact with the atmosphere or corrosion due to adhesion of moisture or the like included in the atmosphere. As with the second protective layer 27, the third protective layer 29 can be formed with, for example, a resin material such as an epoxy resin or a polyimide resin. The third protective layer 29 can be formed by using, for example, a thick-film forming technology such as a screen printing method.

As illustrated in FIGS. 3 and 4, an area, in the vicinity of the second end face 7*b*, of the common electrode 17 on the second main surface 7*d* of the substrate 7 is not covered by the third protective layer 29 but is covered by the covering layer 30.

As illustrated in FIGS. 4 and 5, an area of the common electrode 17, the area being located on an angular part 7*e* formed with the first main surface 7*c* and second end face 7*b* of the substrate 7 and on an angular part 7*f* formed with the second main surface 7*d* and second end face 7*b* of the substrate 7, is covered by the covering layer 30 formed by plating. To be more specific, the covering layer 30 continuously covers the entire area of the common electrode 17 on the first main surface 7*c* and second end face 7*b* of the substrate 7 and the area, in the vicinity of the second end face 7*b*, of the common electrode 17 on the second main surface 7*d* of the substrate 7.

The covering layer 30 can be formed by, for example, known electroless plating or electrolytic plating. As the covering layer 30, a first covering layer, which is nickel-plated, may be formed on the common electrode 17 and a second layer, which is gold-plated, may be formed on this first covering layer, for example. In this case, the thickness of the first covering layer can be, for example, 1.5 μm to 4 μm, and the thickness of the second covering layer can be, for example, 0.02 μm to 0.1 μm.

In this embodiment, as illustrated in FIG. 3, the covering layer 30 formed by plating is also formed on the ends of the IC-FPC connection electrodes 21 connected to the FPC 5. Thus, the FPC 5 is connected onto the covering layer 30 as described later.

Furthermore, in this embodiment, as illustrated in FIG. 3, the covering layer 30 formed by plating is also formed on the ends of the individual electrodes 19 and IC-FPC connection electrodes 21, the ends being exposed from the openings 27*a* of the second protective layer 27. Thus, the driving IC 11*a* is connected through this covering layer 30 to the individual electrodes 19 and IC-FPC connection electrodes 21 as described above.

As illustrated in FIGS. 1, 4, and 5, the FPC 5 extends in the array direction of the plurality of heat generating members 9 and is connected to the extending portion 17*a* of the common electrode 17 disposed on the first main surface 7*c* of the substrate 7 as described above, to the protrusion 17*b* of the common electrode 17, and to each IC-FPC connection electrode 21. As the FPC 5, a known FPC can be used in which a plurality of print wires 5*b* are routed in an insulative resin layer. Each print wire 5*b* is externally connected through a connector 31 to a power supply unit, a control unit, and the like (these units are not illustrated). The print wire 5*b* of this type is generally formed with a conductive thin film that is formed from, for example, a metal foil such as a copper foil, a thin conductive film formed by a thin-film forming technology, or a thick conductive film formed by a thick-film printing technology. The print wire 5*b* formed with a metal foil, a thin conductive film, or the like is patterned by, for example, being partially etched by photo-etching or the like.

To be more specific, as illustrated in FIGS. 4 and 5, with the FPC 5, each print wire 5*b* formed in a resin layer 5*a*, which is insulative, is exposed at an end near the head base substrate 3 and is connected to the common electrode 17 and IC-FPC connection electrode 21 through a bonding material 32 that is a conductive bonding material, which is, for example, a solder material or an anisotropic conductive film (ACF) formed by mixing conductive particles into an electric insulating resin.

Since, in this embodiment, the covering layer 30 is formed on the common electrode 17 on the first main surface 7*c* of the substrate 7, each print wire 5*b* connected to the common electrode 17 is connected through the bonding material 32 to this covering layer 30. Since the covering layer 30 is also formed on the ends of the IC-FPC connection electrodes 21 as illustrated in FIG. 4, the print wire 5*b* connected to each IC-FPC connection electrode 21 is connected through the bonding material 32 onto this covering layer 30. Thus, intensity with which the print wire 5*b* is connected onto the common electrode 17 and IC-FPC connection electrode 21 can be increased by connecting the print wire 5*b* onto the covering layer 30 formed by plating.

When each print wire 5*b* of the FPC 5 is externally connected through the connector 31 to a power supply unit, a control unit, and the like (these units are not illustrated), the common electrode 17 is electrically connected to a positive terminal of the power supply unit, the positive terminal being held at a positive potential of, for example, 20 to 24 V. The individual electrode 19 is electrically connected through the driving IC 11*a* and the ground electrode 24 of the IC-FPC connection electrodes 21 to a negative terminal of the power supply unit, the negative terminal being held to a ground potential. Therefore, when the switching element of the driving IC 11*a* is turned on, a voltage is applied to the heat generating part 9, causing the heat generating part 9 to generate heat.

Similarly, when each print wire 5*b* of the FPC 5 is externally connected through the connector 31 to the power supply unit, the control unit, and the like (these units are not illustrated), the above IC electrode 22 of the IC-FPC connection electrodes 21 is electrically connected to the positive terminal of the power supply unit, the positive terminal being held at a positive potential, as with the common electrode 17. Thus, a voltage used to operate the driving IC 11*a* is applied to the driving IC 11*a* due to a difference in electric potential between the ground electrode 24 and the IC electrode 22 of the IC-FPC connection electrodes 21 to which the driving IC 11*a* is connected. The above IC electrode 22 of the IC-FPC connection electrodes 21 is electrically connected to the external control unit, which controls the driving IC 11*a*. Thus, an electric signal transmitted from the control unit is supplied to the driving IC 11*a*. Each heat generating part 9 can selectively generate heat by operating the driving IC 11*a* so as to control the turned-on and turned-off states of each switching element in the driving IC 11*a* by the electric signal.

The FPC 5 is secured onto the heat dissipating body 1 by being bonded to the upper surface of the protrusion 1*b* of the heat dissipating body 1 with, for example, a double-sided adhesive tape or adhesive (not illustrated).

Although, in the first embodiment, an example in which the common electrode 17 is disposed over the entire surface of the second main surface 7*d* has been indicated, the common electrode 17 may not be disposed over the entire surface of eh second main surface 7*d*. Even in this case, the first reinforcing member 8 can be formed at the end of the substrate 7 in the array direction of the heat generating members 9 by disposing the common electrode 17 at the end of the substrate 7 in the array direction of the heat generating members 9, so it is possible to suppress the possibility that chipping or cracking occurs in the thermal head X1.

The covering layer 30 may be disposed on the common electrode 17 at the end of the substrate 7 in the array direction of the heat generating members 9. Even in this case, the strength of the edge portion 7*g* of the substrate 7 can be further improved in the array direction of the heat generating members 9.

Although an example in which the first reinforcing member 8 is formed with the protrusion 17*b* of the common electrode 17, this is not a limitation; for example, the first reinforcing member 8 may be formed with the extending portion 17*a* of the common electrode 17.

A method by which a thermal head substrate Y1 is divided to manufactures thermal heads X1 will be described will be described.

Figure 6:
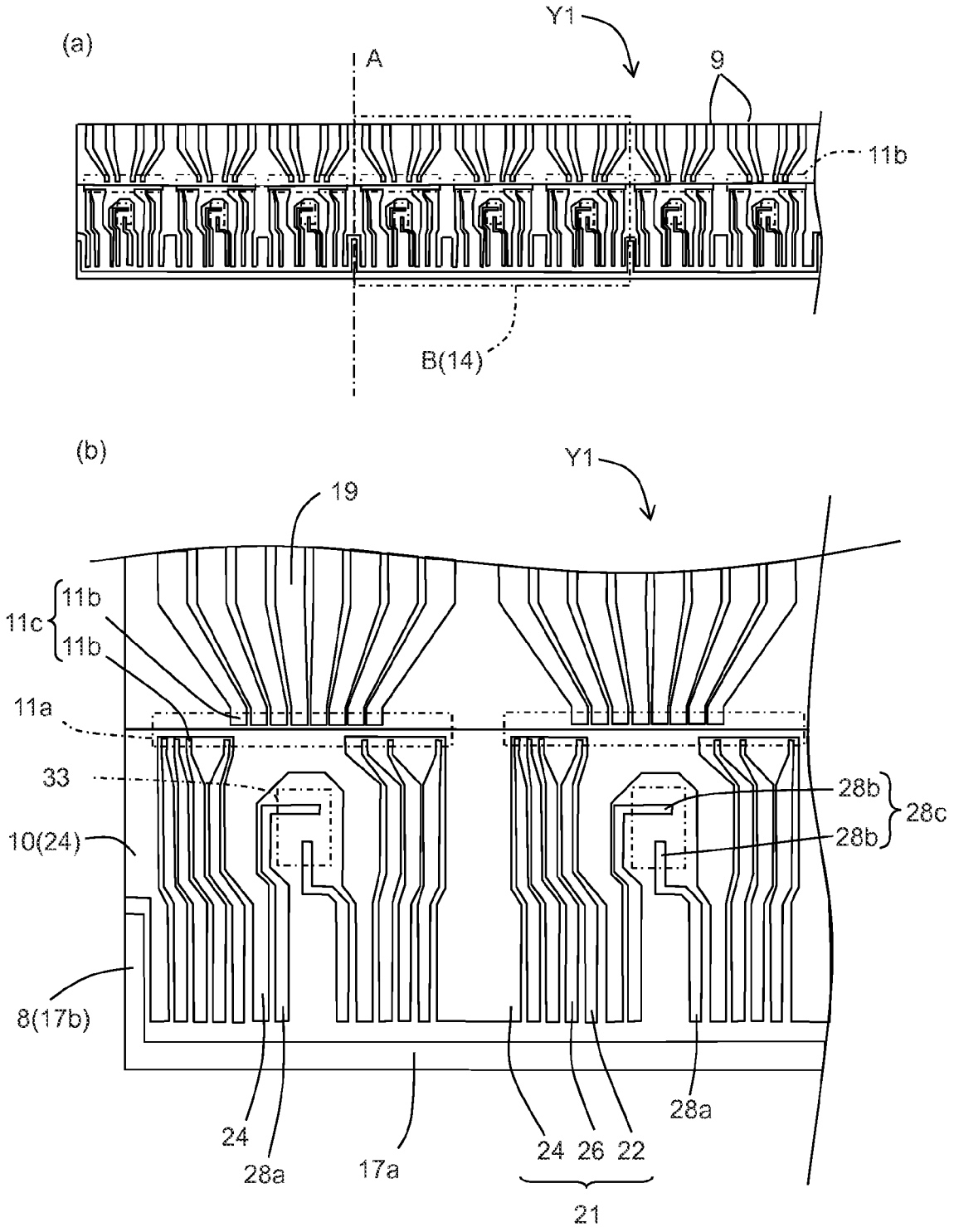
FIG. 6(*a*) is a plan view of a thermal head substrate for use in the thermal head in FIG. 1, and FIG. 6(*b*) is an enlarged plan view in which part of FIG. 6(*a*) is enlarged.
Figure 7:
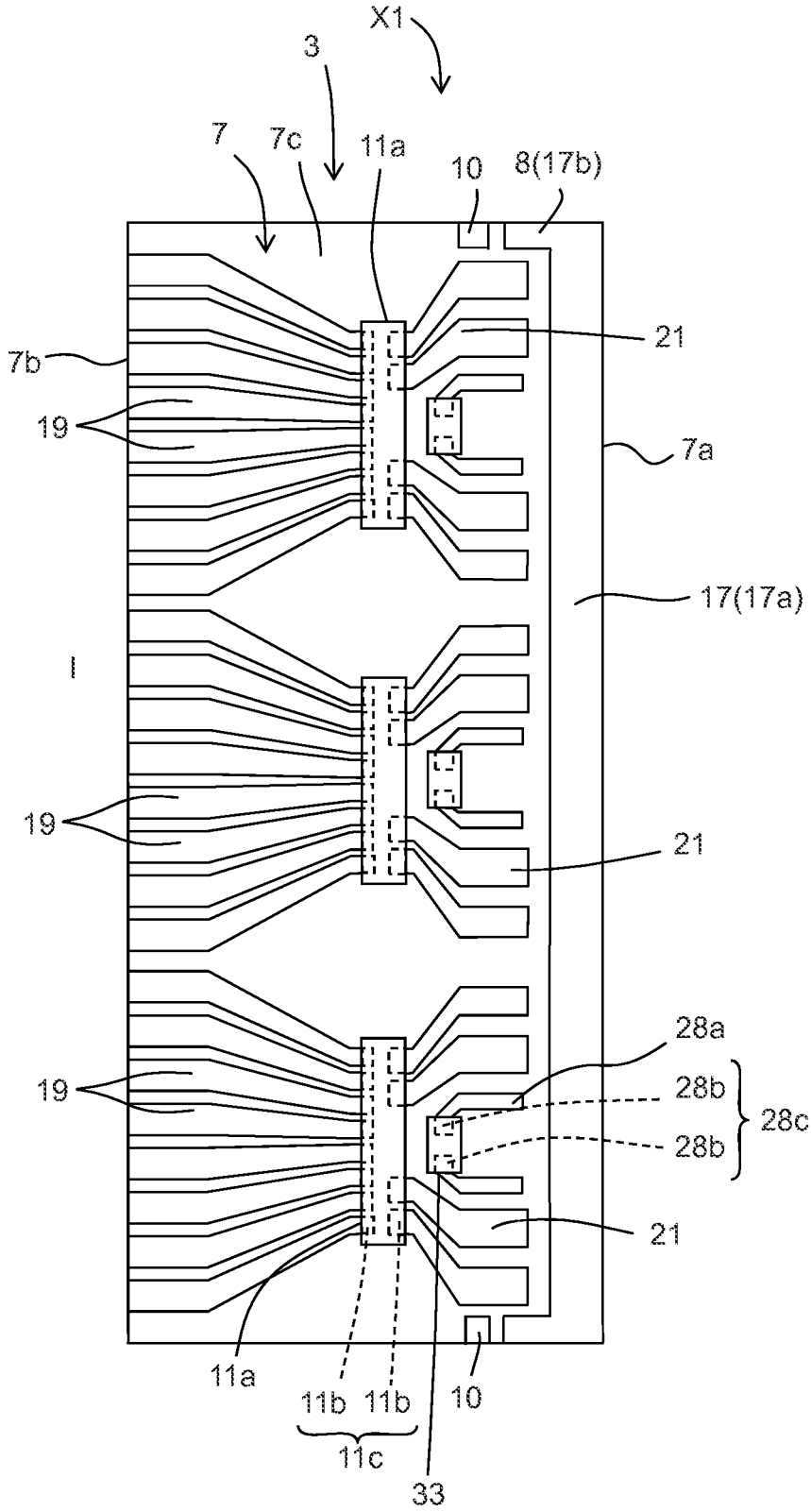
FIG. 7 is a schematic plan view that schematically illustrates a thermal head manufactured from the thermal head substrate in FIG. 6.

FIG. 6 is a plan view of the thermal head substrate Y1, and FIG. 7 is a schematic plan view that schematically indicates the thermal head X1 manufactured by dividing the thermal head substrate Y1.

As illustrated in FIG. 6, the thermal head substrate Y1 includes a plurality of heat generating members 9, control terminal groups 11*c*, individual electrodes 19, IC-FPC connection electrodes 21, and temperature measurement terminal groups 28*c*. Each control terminal group 11*c* includes a plurality of control terminals 11*b* used to mount the driving IC 11*a*. Each temperature measurement terminal group 28*c* includes a plurality of temperature measurement terminals 28*b*, which are electronic-part-oriented terminals used to mount the temperature measuring member 33 and other electronic parts. Although the driving IC 11*a* and temperature measuring member 33 are not mounted on the thermal head substrate Y1, the positions at which to mount them are indicated by dash-dot lines.

The thermal head substrate Y1 includes a zone 14, which is an area enclosed by B, the area including heat generating members 9, a plurality of control terminal groups 11*c*, a plurality of individual electrodes 19, a plurality of IC-FPC connection electrodes 21, each of which is formed with the IC electrode 22, ground electrode 24, and IC control electrode 26, and three temperature measurement terminal groups 28*c*. A plurality of zones 14 are placed in the array direction of the heat generating members 9, that is, in the right and left direction in FIG. 6, by repeatedly placing the zone 14 equivalently.

The thermal head X1 can be manufactured by dividing this thermal head substrate Y1 into zones. Specifically, the thermal head substrate Y1 can be divided by performing marking at a portion indicated by A in FIG. 6 and then performing laser cutting. Alternatively, to manufacture the thermal head X1, a groove called a scribe may be formed by laser machining at the portion at which marking has been performed, after which the thermal head substrate Y1 may be pressed to divide it.

Then, the thermal head X1 can be manufactured by mounting driving ICs 11*a*, temperature measuring members 33, capacitors (not illustrated), resistors (not illustrated), coils (not illustrated), and other electronic parts on the divided thermal head substrate Y1.

Figure 8:
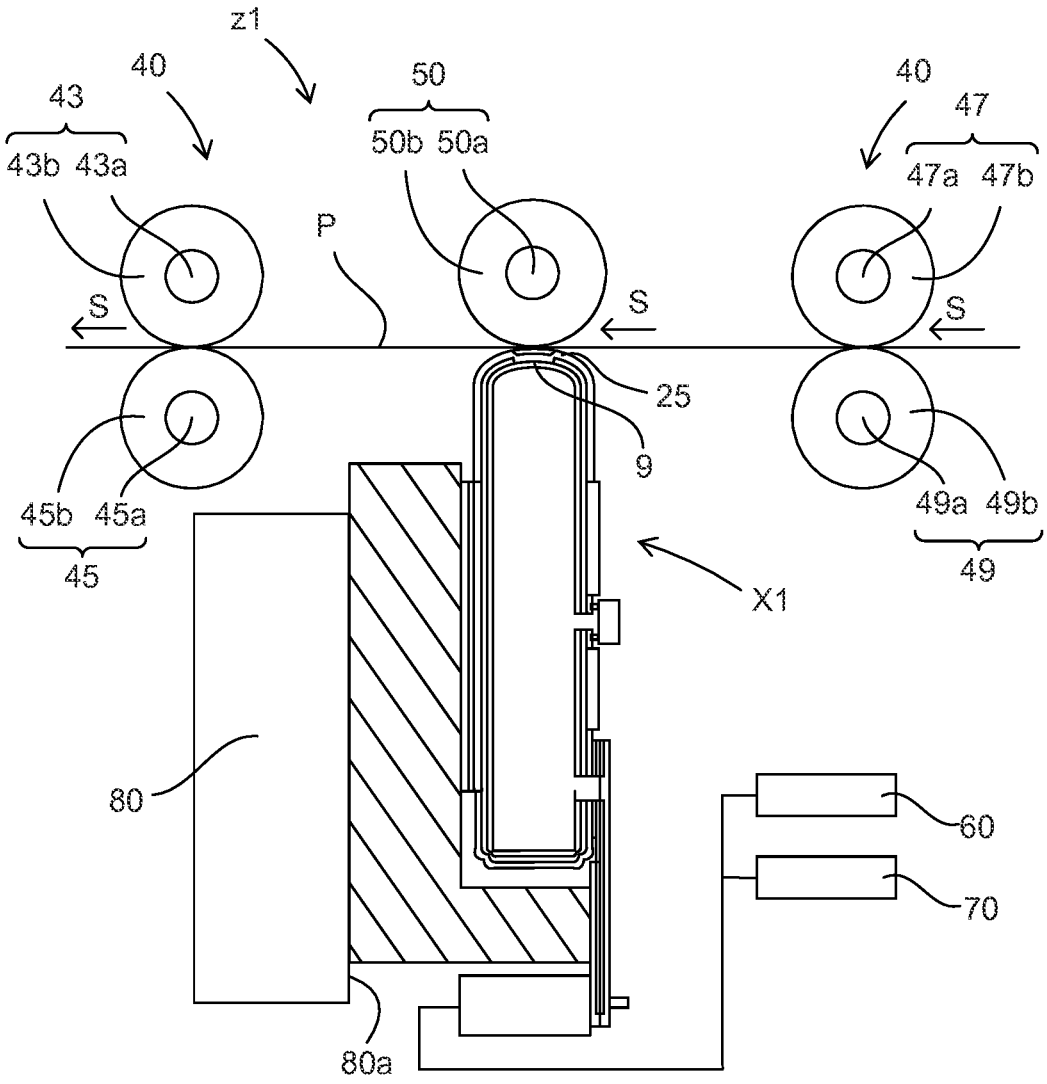
FIG. 8 is a schematic structural diagram illustrating a thermal printer according to an embodiment of the present invention.

Next, a thermal printer that uses the thermal head X1, which is a first embodiment, will be described with reference to FIG. 8. FIG. 8 is a schematic structural diagram illustrating a thermal printer Z1 in this embodiment.

As illustrated in FIG. 8, the thermal printer Z1 in this embodiment includes the thermal head X1 described above, a conveying mechanism 40, a platen roller 50, a power supply unit 60, and a control unit 70. The thermal head X1 is attached to an attachment surface 80*a* of the attachment member 80 provided in a case (not illustrated) of the thermal printer Z1. The thermal head X1 is attached to the attachment member 80 so that the array direction of the heat generating members 9 is orthogonal to a conveying direction S, described later, in which a recoding paper P is conveyed, that is, so as to be along a main scanning direction.

The conveying mechanism 40 conveys the recoding paper P such as heat-sensitive paper, image reception paper, or a card in the conveying direction S in FIG. 8 to convey the recoding paper P onto the plurality of heat generating members 9 of the thermal head X1 (to be more specific, onto the first protective layer 25). The conveying mechanism 40 includes conveying rollers 43, 45, 47, and 49. The conveying rollers 43, 45, 47, and 49 can be formed by, for example, covering axial bodies 43*a*, 45*a*, 47*a*, and 49*a*, which are cylindrical and are made of stainless steel or another metal, with elastic members 43*b*, 45*b*, 47*b*, and 49*b*, which are made of butadiene rubber or the like. Although not illustrated, if the recoding paper P is image reception paper, a card, or the like, an ink film is conveyed between the recoding paper P and the heat generating members 9 of the thermal head X1 together with the recoding paper P.

The platen roller 50, which presses the recoding paper P against the heat generating members 9 of the thermal head X1, is disposed so as to extend along a direction orthogonal to the conveying direction S of the recoding paper P. Both ends of platen roller 50 are supported so as to be rotatable with the recoding paper P pressed against the heat generating members 9. The platen roller 50 can be formed by, for example, covering a cylindrical axial body 50*a*, which is made of stainless steel or another metal, with an elastic member 50*b*, which is made of butadiene rubber or the like.

The power supply unit 60 supplies a current used to have the heat generating part 9 of the thermal head X1 generate heat and also supplies a current used to operate the driving IC 11*a* as described above. To cause the heat generating members 9 of the thermal head X1 to selectively generate heat as described above, the control unit 70 supplies a control signal, which controls the operation of the driving IC 11*a*, to the driving IC 11*a*.

As illustrated in FIG. 8, the thermal printer Z in this embodiment can perform prescribed printing on the recoding paper P by using the power supply unit 60 and control unit 70 to cause the heat generating members 9 to selectively generate heat while the conveying mechanism 40 is conveying the recoding paper P on the heat generating members 9 of the thermal head X1. If the recoding paper P is an image reception paper, a card, or the like, printing on the recoding paper P can be performed by thermally transferring ink on an ink film (not illustrated), which is conveyed together with the recoding paper P, to the recoding paper P.

Second Embodiment

A second embodiment of the present invention will be described with reference to FIG. 9.

Figure 9:
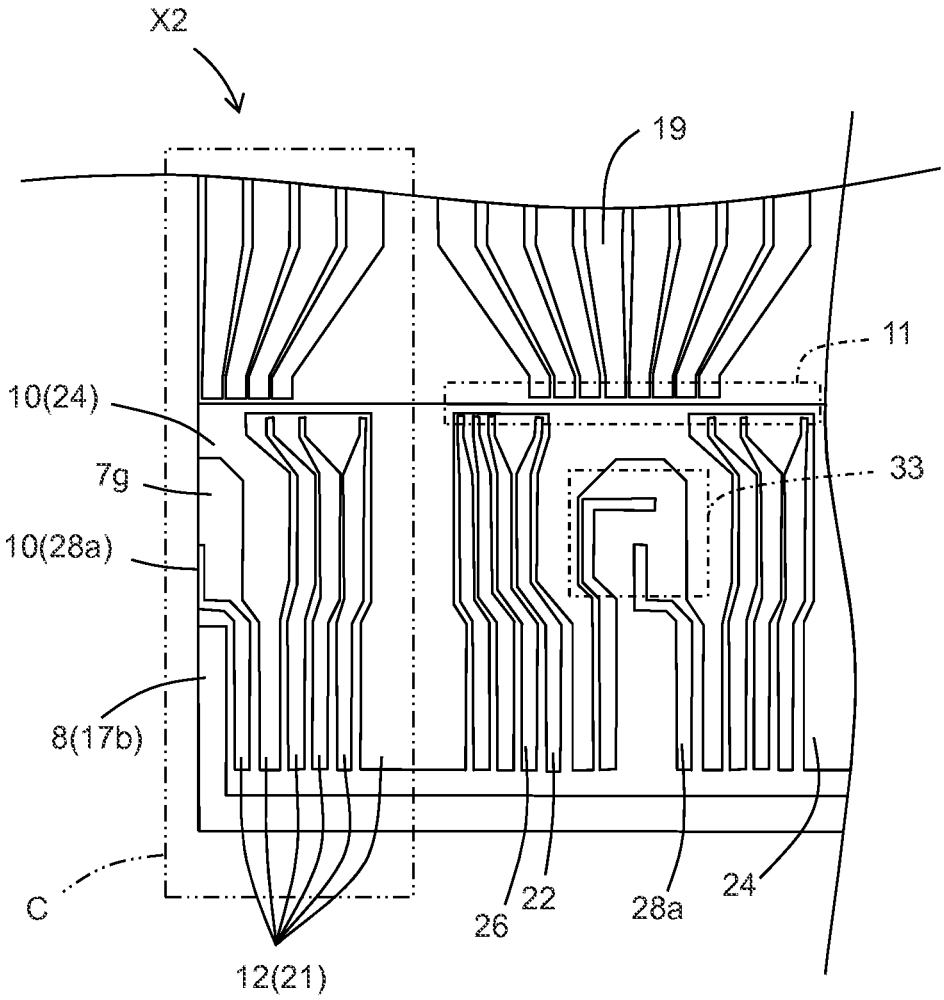
FIG. 9 is a plan view illustrating an enlarged view of an edge portion of the substrate in the direction in which the heat generating members of the thermal head according to another embodiment of the present invention are arrayed.

The thermal head X2 illustrated in FIG. 9 includes a second reinforcing member 10 in a portion enclosed by dash-dot-dot lines C. The IC-FPC connection electrode 21 is provided as the second reinforcing member 10. For each IC-FPC connection electrode 21, the IC electrode 22, ground electrode 24, IC control electrode 26, and temperature measuring electrode 28*a* constitute a bonded auxiliary member 12, as described above. Other structures are the same as in the first embodiment.

In the second embodiment as well, the common electrode 17 is disposed at the edge portion 7*g* of the substrate 7. Therefore, the common electrode 17 functions as the first reinforcing member 8 and the ground electrode 24 functions as bonded auxiliary members 12, enabling the strength of the edge portion 7*g* of the substrate 7 to be improved.

With the thermal head X2 in the second embodiment, the FPC 5 and substrate 7 are electrically connected at another end of the common electrode 17. To be more specific, they are electrically connected through the extending portion 17*a* and protrusion 17*b*. Similarly, another end of the IC-FPC connection electrode 21 and the FPC 5 are electrically connected. To be more specific, the FPC 5 and the IC electrode 22, ground electrode 24, IC control electrode 26 and temperature measuring electrode 28*a* are electrically connected.

If the substrate is formed with a ceramic material and the FPC is formed with a resin material, they have different coefficients of thermal expansion due to the different materials with which the substrate and FPC are formed, so when the thermal head operates, the FPC may cause a deformation extending in the array direction of the heat generating members 9 when compared with the substrate. The FPC may be separated from the substrate due to stress caused by the deformation. This is likely to occur particularly at an edge portion of the substrate at which the amount of deformation is particularly large.

With the thermal head X2 in the second embodiment, since the bonded auxiliary member 12 is disposed at a distance from the first reinforcing member 8 in the array direction of the heat generating members 9, if the IC-FPC connection electrode 21 provided as the bonded auxiliary member 12 and the print wire 5*b* of the FPC 5 are connected by soldering, the stress caused by the deformation of the FPC 5 can be alleviated by the solder. Accordingly, the possibility that separation between the substrate 7 and the FPC 5 occurs can be reduced. That is, an area in which the substrate 7 and FPC 5 are bonded can be increased when compared with a case in which the bonded auxiliary member 12 is not provided, so stress generated at each solder with which the substrate 7 and FPC 5 are connected can be distributed. Accordingly, the possibility that separation between the substrate 7 and the FPC 5 occurs can be reduced.

Furthermore, since the common electrode 17 is provided at the edge portion 7*g* of the substrate 7 as the first reinforcing member 8, stress generated at the edge portion 7*g* of the substrate 7 at which separation is particularly likely to occur can be reduced. Accordingly, the possibility that separation between the substrate 7 and the FPC 5 occurs can be reduced.

Furthermore, if the stress caused by deformation of the FPC 5 is large, the FPC 5 and the bonded auxiliary member 12 at the edge portion 7*g* of the substrate 7 may be separated from each other. Even if the FPC 5 and bonded auxiliary member 12 are separated from each other, since the bonded auxiliary member 12 and FPC 5 are not electrically connected, the possibility that the electric connection between the substrate 7 and FPC 5 is broken can be reduced.

Even in a case in which the substrate 7 and FPC 5 are connected through an ACF connection in which an electrically conductive adhesive with anisotropy is used, since the common electrode 17 is provided as the first reinforcing member 8 or the IC-FPC connection electrode 21 is provided as the bonded auxiliary member 12, the electrically conductive adhesive with anisotropy can have a more even thickness in the array direction of the heat generating members 9. That is, if the bonded auxiliary member 12 is not provided, the thickness of the edge portion 7*g* of the substrate 7 is reduced by an amount equal to the thickness of the bonded auxiliary member 12, so the bonding strength of the edge portion 7*g* of the substrate 7 may be reduced. With the thermal head X2, however, since the bonded auxiliary member 12 is provided, the electrically conductive adhesive with anisotropy can have a more even thickness in the array direction of the heat generating members 9. Accordingly, the electrically conductive adhesive with anisotropy can have a more even thickness in the array direction of the heat generating members 9, so bonding strength between the substrate 7 and the FPC 5 can be improved.

When the IC-FPC connection electrode 21 is used as the bonded auxiliary member 12, the bonded auxiliary member 12 can be easily disposed on the substrate 7 without having to create a separate pattern.

The method of connecting the substrate 7 and FPC 5 is not limited to a connection by soldering or an ACF connection. Even in a case in which an electrically conductive adhesive, for example, is used for bonding instead of solder, the connection between the substrate 7 and the FPC 5 can be strengthened.

Third Embodiment

Figure 10:
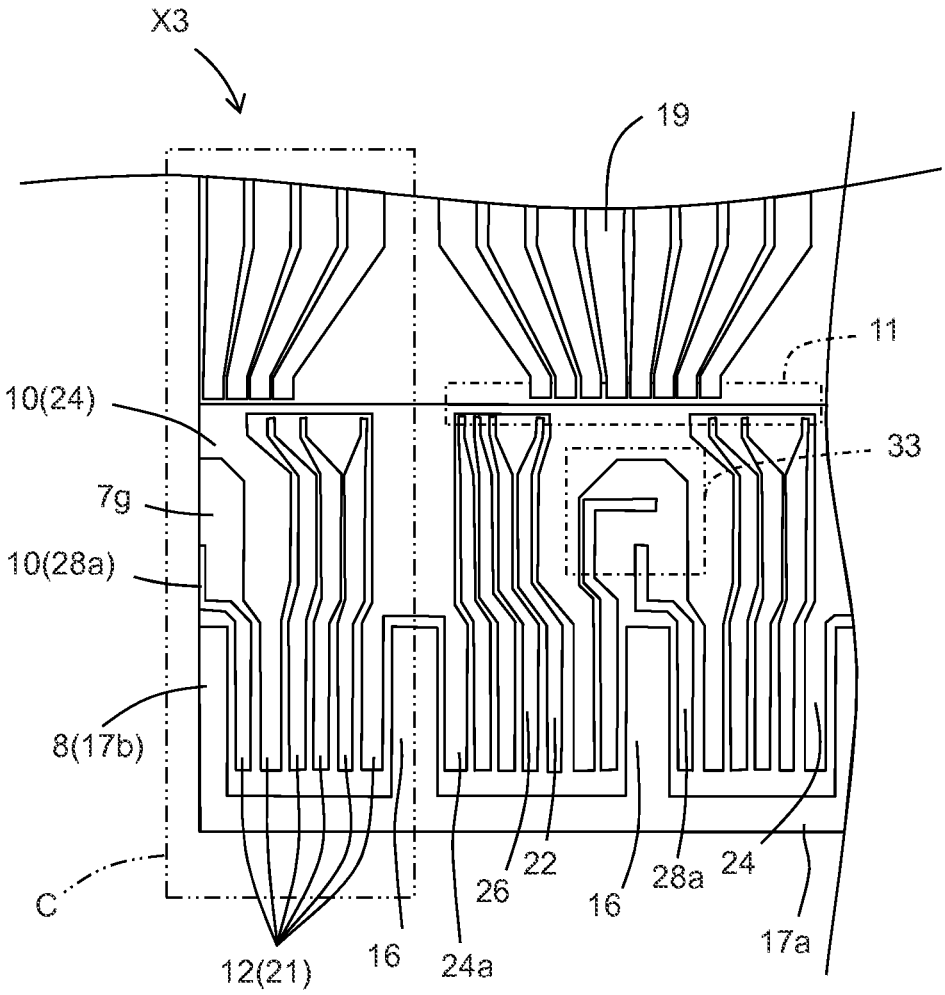
FIG. 10 is a plan view illustrating an enlarged view of an edge portion of the substrate in the direction in which the heat generating members of the thermal head according to yet another embodiment of the present invention are arrayed.

As illustrated in FIG. 10, a thermal head X3 in a third embodiment includes protruding portions 16, each of which protrudes from the extending portion 17*a* of the common electrode 17 on the first main surface 7*c* toward the ground electrode 24. That is, the thermal head X3 has a plurality of protruding portions 16 protruding toward the IC-FPC connection electrodes 21. The thermal head X3 also includes other protruding portions 16, each of which protrudes from the extending portion 17*a* of the common electrode 17 on the first main surface 7*c* toward to the temperature measuring electrode 28*a* on which the temperature measuring member 33 is mounted. The protruding portion 16 protruding toward the temperature measuring electrode 28*a* of the first electrode extends to an area in which the temperature measuring member 33 is mounted so as to be below the temperature measuring member 33.

As illustrated in FIG. 10, the IC-FPC connection electrodes 21, which connect the driving IC 11*a* and FPC 5, are wired at a high density. Therefore, high heat is generated during the operation of the thermal head X3, so the temperature measuring member 33 disposed on the temperature measuring electrode 28*a* senses a temperature higher than the actual temperature. Accordingly, there may be a case in which the thermal head X3 cannot be precisely controlled.

Since the thermal head X3 in the third embodiment includes the protruding portion 16, extending toward the IC-FPC connection electrodes 21, of the common electrode 17, heat near the IC-FPC connection electrodes 21 is dissipated through the protruding portion 16 to the common electrode 17 on the second main surface 7*d*. Therefore, the heat near the IC-FPC connection electrodes 21 can be efficiently dissipated, enabling the temperature measuring member 33 to measure a temperature accurately. Accordingly, the thermal head X3 can be precisely controlled. The protruding portion 16, extending toward the temperature measuring electrode 28*a*, of the first electrode may not extend to the area in which the temperature measuring member 33 is mounted. Even in this case, it is possible to reduce the possibility that the vicinity of the temperature measuring member 33 becomes hot.

Now, a thermal head substrate Y2 used to manufacture the thermal head X3 will be described with reference to FIGS. 11 and 12.

Figure 11:
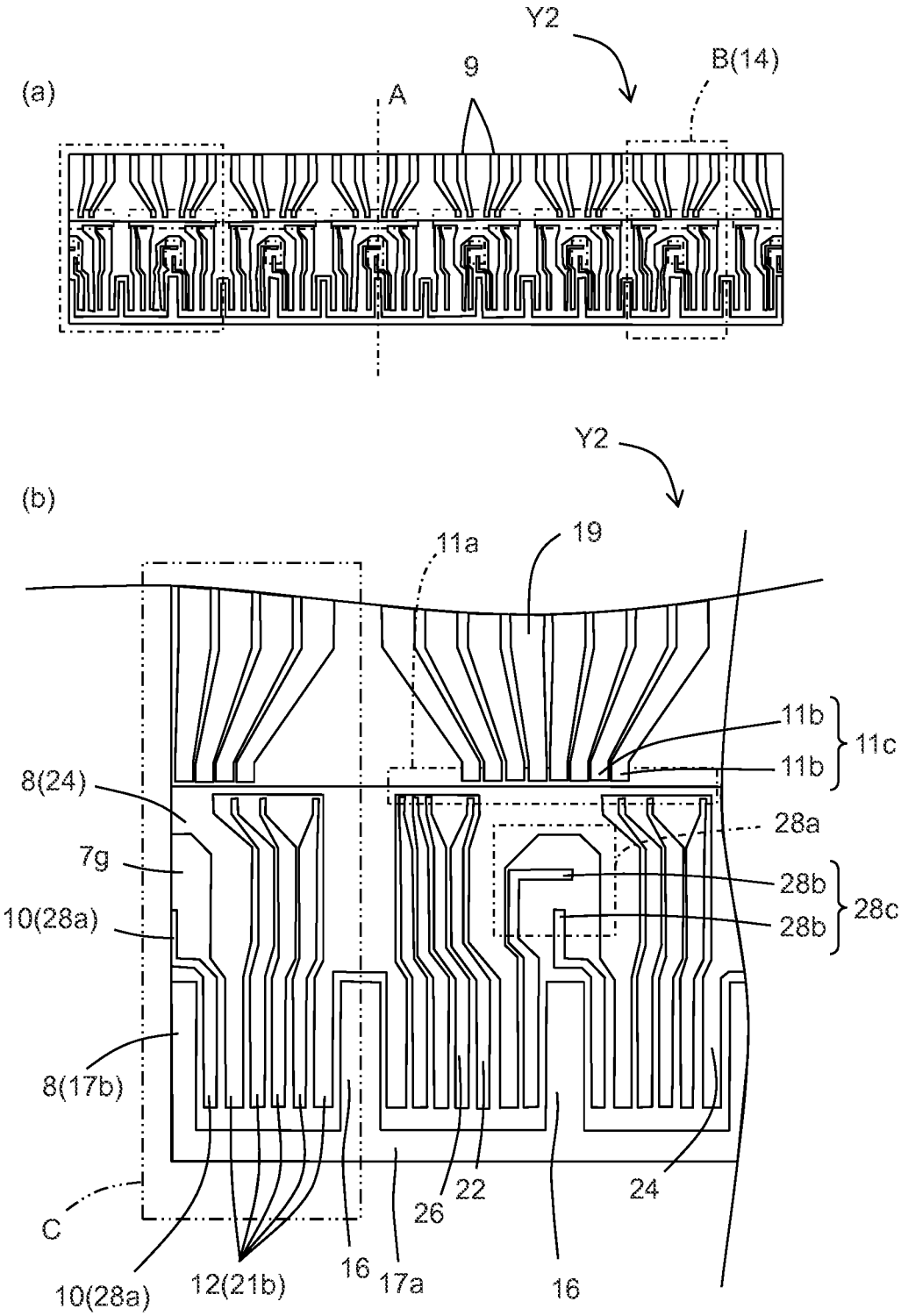
FIG. 11(*a*) is a plan view of a thermal head substrate for use in the thermal head in FIG. 10, and FIG. 11(*b*) is an enlarged plan view in which part of FIG. 11(*a*) is enlarged.
Figure 12:
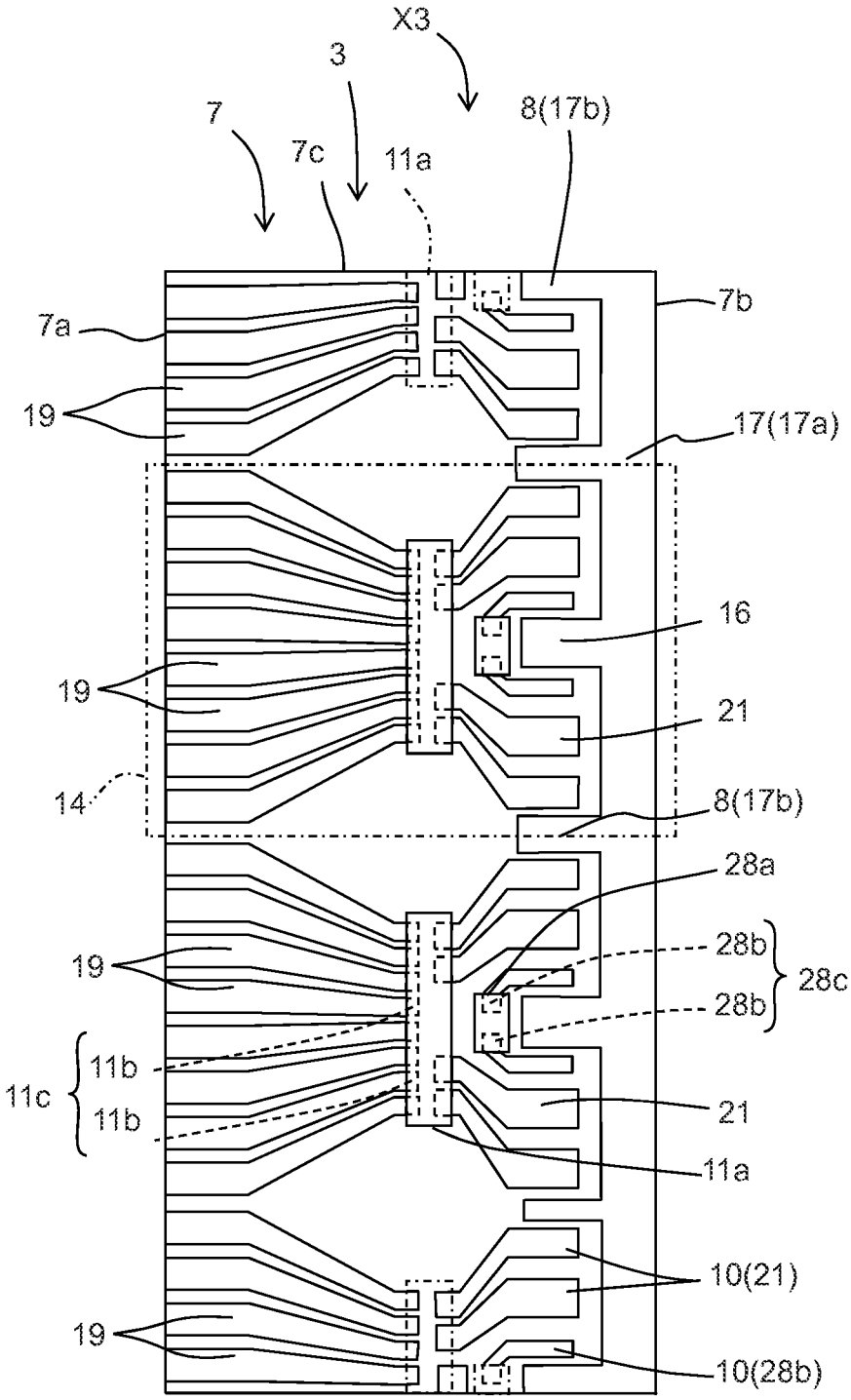
FIG. 12 is a schematic plan view that schematically illustrates a thermal head manufactured from the thermal head substrate in FIG. 11.

The thermal head substrate Y2 in FIG. 11 includes the bonded auxiliary member 12 at both ends in the array direction of the heat generating members 9. The thermal head substrate Y2 further has the protruding portions 16, each of which protrudes from the extending portion 17*a* of the common electrode 17 toward the temperature measurement terminal group 28*c*.

As illustrated in FIG. 11(*b*), a portion enclosed by two dash-dot lines C functions as bonded auxiliary members 12. The bonded auxiliary members 12 include the IC-FPC connection electrodes 21; the bonded auxiliary members 12 include the IC electrode 22, ground electrode 24, IC control electrode 26, and temperature measuring electrode 28*a* as described above. Furthermore, the temperature measurement terminal group 28*c* is also included in the bonded auxiliary members 12. Other structures are the same as with the thermal head substrate Y1 in the first embodiment.

On the thermal head substrate Y2, the zone 14 indicated by B is repeatedly patterned in the longitudinal direction of the thermal head substrate Y2. The zone 14 includes a plurality of individual electrodes 19, the IC-FPC connection electrode 21, the temperature measuring electrode 28*a*, and common electrode 17. To be more specific, as illustrated in FIG. 11(*b*), the zone 14 is disposed so as to be enclosed by the ground electrode 24, the extending portion 17*a* of the common electrode 17, and the protruding portion 16 of the common electrode 17; the temperature measurement terminal group 28*c*, control terminal group 11*c*, and protruding portion 16 are provided in the zone 14.

Thus, since bonded auxiliary member 12 is provided at both ends in the array direction of the heat generating members 9, when the thermal head X3 is manufactured by dividing the thermal head substrate Y2, the bonded auxiliary member 12 can be provided at each end of the thermal head X3.

Since the thermal head X3 can be manufactured by dividing the thermal head substrate Y2 on which the zone 14 is repeatedly formed equivalently, the thermal head X3 with an arbitrary length can be easily manufactured. Since the zone 14 includes the temperature measurement terminal group 28*c*, after the thermal head substrate Y2 is divided, any temperature measuring member 33 and the like can be attached to the temperature measurement terminal group 28*c* according to the purpose. Therefore, the structure of the thermal head X3 can be easily changed and the design of the thermal head X3 can be easily changed.

When the thermal head substrate Y2 is divided by using a temperature measuring electrode 28*d* as a marker, the thermal head X3 including the bonded auxiliary members 12 in the array direction of the heat generating members 9 can be easily manufactured.

Since the zone 14 includes one control terminal group 11*c*, the length of the thermal head X3 can be changed for each group of heat generating members 9 corresponding to one driving IC 11*a*. This can improve the productivity of the thermal head.

Fourth Embodiment

Figure 13:
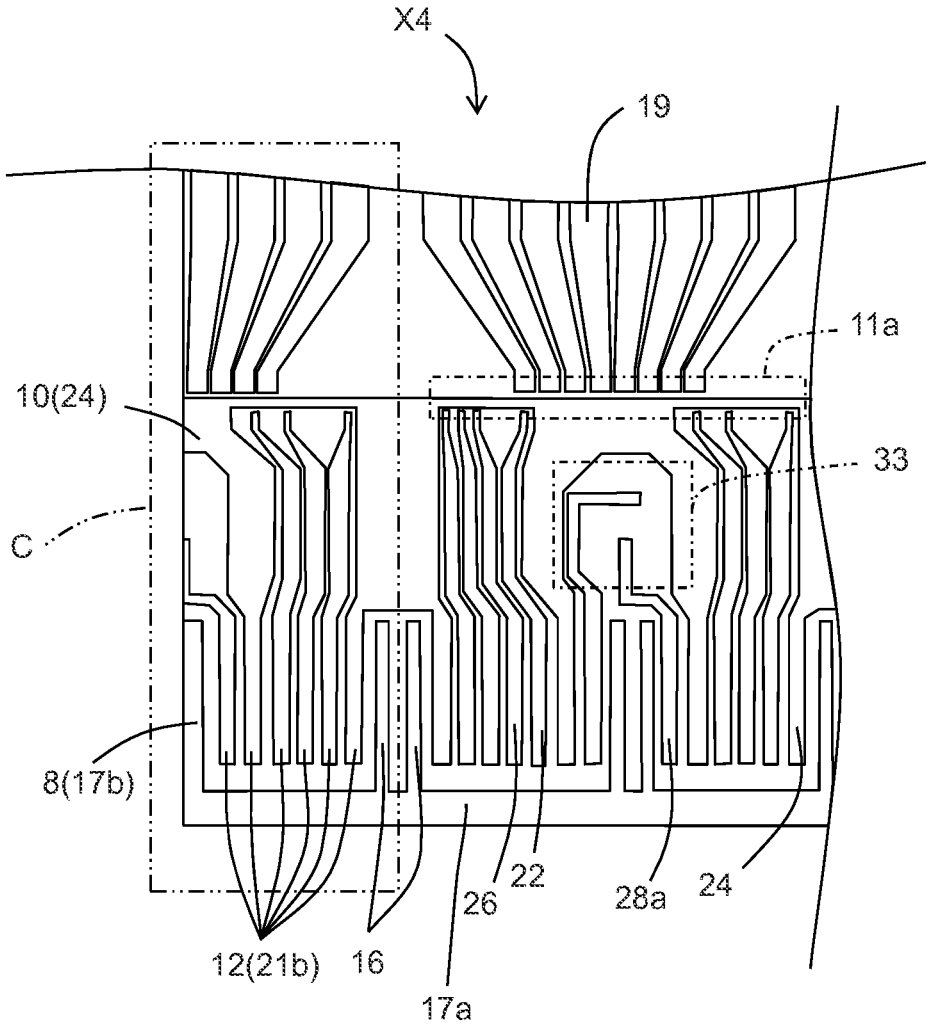
FIG. 13 is a plan view illustrating an enlarged view of an edge portion of the substrate in the direction in which the heat generating members of the thermal head according to still another embodiment of the present invention are arrayed.

With a thermal head X4 in a fourth embodiment, as illustrated in FIG. 13, the protruding portion 16 indicated in the thermal head X3 in the third embodiment is divided into a plurality of parts. The IC-FPC connection electrodes 21 include a plurality of protruding portions 21*b*, each of which is adjacent to the protruding portion 16 of the common electrode 17. The IC-FPC connection electrodes 21 are connected to the print wires 5*b* of the FPC 5. The width of the protruding portion 21*b* of the IC-FPC connection electrode 21 in the array direction of the heat generating members 9 is substantially the same as the width of the protruding portion 16 of the common electrode 17 in the array direction of the heat generating members 9.

Therefore, when the substrate 7 and FPC 5 are bonded by soldering, the state of a connection between the protruding portion 16 and the print wire 5*b* of the FPC 5 and the state of a connection between each IC-FPC connection electrode 21 and the print wire 5*b* are similar in shape. That is, solder forms fillets for connection, and these fillets can be made to approach the same shape. Accordingly, stress generated at each solder by which the substrate 7 and the FPC 5 are connected can be made more even, so bonding strength between the substrate 7 and the FPC 5 can be improved.

Even in a case in which an ACF connection is established, the width of the protruding portion 16 and the width of each IC-FPC connection electrode 21 become substantially the same in the array direction of the heat generating members 9, so the electrically conductive adhesive with anisotropy, which has been disposed on the second reinforcing member 10, can evenly flow between IC-FPC connection electrodes 21. Accordingly, the electrically conductive adhesive with anisotropy, which has been disposed on the IC-FPC connection electrode 21, can have a more even thickness.

Thus, the electrically conductive adhesives with anisotropy can have a more even thickness in the array direction of the heat generating members 9, so bonding strength can also be made to be more even.

When saying that the width of the IC-FPC connection electrode 21 in the array direction of the heat generating members 9 and the width of the common electrode 17 in the array direction of the heat generating members 9 are substantially the same, a range of error generated in a manufacturing process is included.

So far, an embodiment of the present invention has been described, but the present invention is not limited to the above embodiment; various modifications are possible without departing from the intended scope of the invention.

Figure 14:
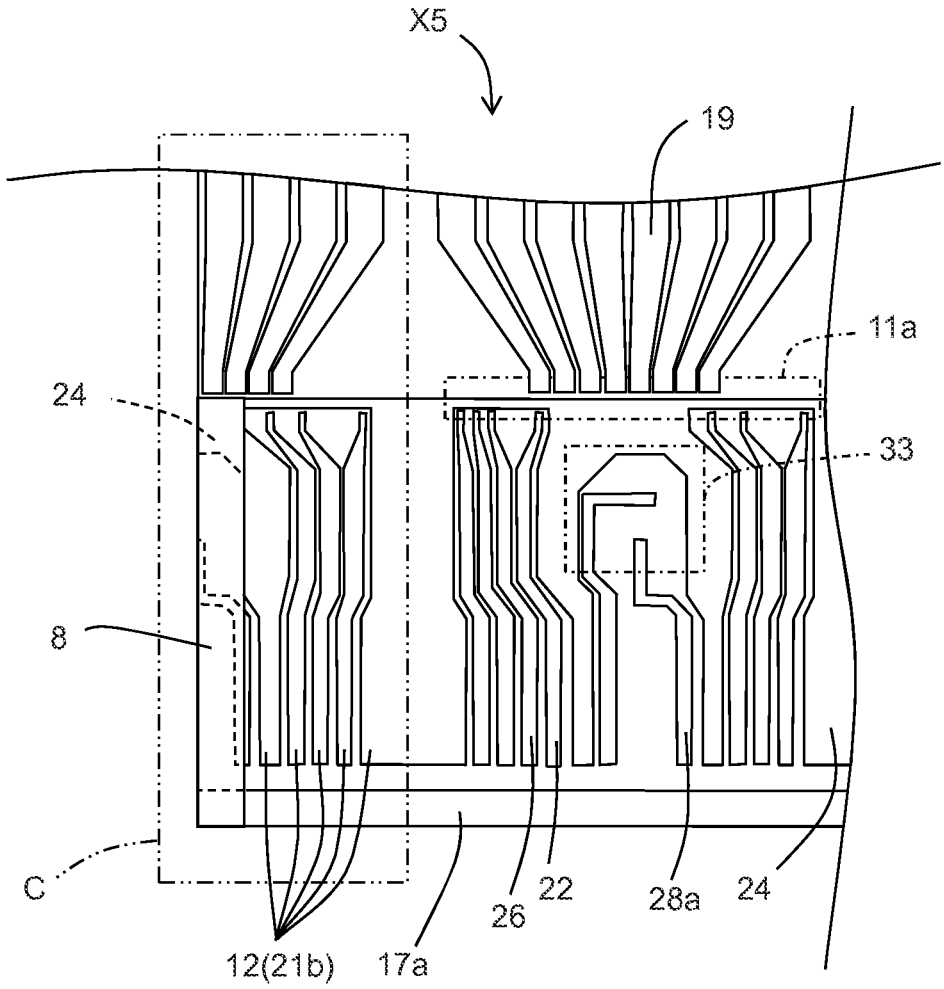
FIG. 14 is a plan view illustrating an enlarged view of an edge portion of the substrate in the direction in which the heat generating members of the thermal head according to still another embodiment of the present invention are arrayed.

For example, as illustrated in FIG. 14, the first reinforcing member 8 and second reinforcing member 10 may be formed as different members instead of forming the first reinforcing member 8 as part of the common electrode 17. In this case, the first reinforcing member 8 and second reinforcing member 10 can be formed with materials equivalent to the material of the second protective layer 27 or first protective layer 25.

When the first reinforcing member 8 and second reinforcing member 10 are provided as different members from the common electrode 17 and IC-FPC connection electrode 21, the first reinforcing member 8 and second reinforcing member 10 can be easily formed in prescribed shapes. In addition, since they do not need to have a function as an electrode, it is also possible to manufacture them with an insulating material. Printing, sputtering, dipping, or the like can be exemplified as the method of forming the first reinforcing member 8 and second reinforcing member 10; they may be formed in a certain method depending on the material with which they are formed.

The first reinforcing member 8 may be formed with part of the common electrode 17. In addition, the first reinforcing member 8 may be provided with a different member. The second reinforcing member 10 may be formed with part of the IC-FPC connection electrode 21. In addition, the second reinforcing member 10 may be provided with a different member. Thus, the strength of the edge portion 7*g* of the substrate 7 can be further improved.

With the thermal heads X1 to X5 described above, the common electrode 17 and IC-FPC connection electrodes 21 disposed on the substrate 7 of the head base substrate 3 are electrically connected externally to an external power supply, a control unit, and the like through the FPC 5, but this is not a limitation; for example, various wires of the head base substrate 3 may be electrically connected externally to a power supply unit and the like through a hard printed wiring board instead of a flexible printed wiring board with flexibility such as the FPC 5. In this case, it is sufficient for the common electrode 17 of the head base substrate 3 and the IC-FPC connection electrodes 21 to be connected to printed wires on the printed wiring board by, for example, wire bonding or the like.

With the thermal heads X1 to X5 in the above embodiments, as illustrated in FIGS. 4 and 5, the electrical resistance layer 15 is provided not only on the heat storage layer 13 but also on the first main surface 7*c* and second main surface 7*d* of the substrate 7. However, this is not a limitation as long as the electrical resistance layer 15 is connected to the common electrode 17 on the second end face 7*b* of the substrate 7 and to the individual electrode 19. For example, the electrical resistance layer 15 may be provided only on the heat storage layer 13. Alternatively, the individual electrode 19 and the common electrode 17 on the second end face 7*b* of the substrate 7 may be formed directly on the heat storage layer 13 and the electrical resistance layer 15 may be provided only in an area between the top of the individual electrodes 19 and the top of the common electrode 17 on the heat storage layer 13.

As the structure of another thermal head, the common electrode 17, for example, may extend from on the second end face 7*b* of the substrate 7 onto the second main surface 7*d* of the substrate 7, may be folded back on the second main surface 7*d* of the substrate 7, and may extend through the second end face 7*b* of the substrate 7 onto the first main surface 7*c* of the substrate 7.

With the thermal heads X1 to X5 in the above embodiments, as illustrated in FIG. 5, the second end face 7*b* of the substrate 7 has a convex curved surface. However, there is no particular limitation on the surface shape and inclination angle of the second end face 7*b* of the substrate 7; it can have any form. For example, the second end face 7*b* of the substrate 7 may have a plane shape or may be formed with a bent surface. The angle between the first main surface 7*c* of the substrate 7 and the second end face 7*b* of the substrate 7 and the angle between the second main surface 7*d* of the substrate 7 and the second end face 7*b* of the substrate 7 may be an acute angle or an obtuse angle instead of a right angle.

With the thermal heads X1 to X5 in the above embodiments, the common electrode 17 extends from on the second end face 7*b* of the substrate 7 through on the second main surface 7*d* of the substrate 7 and the first end face 7*a* of the substrate 7 onto the first main surface 7*c* of the substrate 7, but this is not a limitation. For example, the common electrode 17 may be formed only on the second end face 7*b* and second main surface 7*d* of the substrate 7. In this case, it is sufficient for the print wires 5*b* on the FPC 5 and the common electrode 17 formed on the second main surface 7*d* of the substrate 7 to be connected with separately provided jumper wires.

Although, in the embodiments indicated in this description, an example has been taken in which the first reinforcing member 8 is provided at both ends in the array direction of the heat generating members 9, the first reinforcing member 8 may be provided only any one end. Even in this case, it is possible for the first reinforcing member 8 to reduce the possibility that chipping or cracking occurs in the substrate 7. To suppress chipping or cracking from occurring in the substrate 7, the first reinforcing member 8 is preferably provided at both ends of the substrate 7 in the array direction of the heat generating members 9.

The first reinforcing member 8 may be provided on the end face of the substrate 7 that is orthogonal to the array direction of the heat generating members 9. Even in this case, the strength at the end of the substrate 7 in the array direction of the heat generating members 9 can be further improved.

REFERENCE SIGNS LIST

X1 to X5 thermal head
1 heat dissipating body
3 head base substrate
5 flexible printed wiring board
7 substrate
7*a* first end face
7*d* second end face
7*c* first main surface
7*d* second main surface
7*g* edge part
8 first reinforcing member
9 heat generating part
10 second reinforcing member
11*a* driving IC
12 bonded auxiliary member

14 zone
16 protruding portion
17 common electrode
19 individual electrode
21 IC-FPC connection electrode
22 IC electrode
24 ground electrode
26 IC control electrode
28*a* temperature measuring electrode

What is claimed is:

1. A thermal head comprising:
a substrate comprising:
first and second main surfaces opposing each other; and
a first end face connecting the first main surface and the second main surface;
a plurality of heat generating members on the substrate, parallel to the first end face;
an edge portion on the substrate, crossing an array direction of the heat generating members, and comprising:
a first edge portion on the first main surface;
a second edge portion on the second main surface; and
a third edge portion on the first end face;
a first reinforcing member on the first, second and third edge portions; and
a second reinforcing member on the first edge portion, separated from the first reinforcing member.

2. The thermal head according to claim 1, further comprising:
an external circuit board supplying electricity to the heat generating members; and
a first electrode on the substrate, electrically connected to the heat generating members and the external circuit board,
wherein the first reinforcing member serves as a part of the first electrode.

3. The thermal head according to claim 2, further comprising:
a control unit on the first main surface; and
a second electrode on the first main surface, electrically connected to the control unit and the external circuit board,
wherein the second reinforcing member serves as a part of the second electrode.

4. The thermal head according to claim 3, further comprising:
a bonded auxiliary member on the first main surface, separated from the first reinforcing member, and disposed in the array direction.

5. The thermal head according to claim 2, wherein
the substrate further comprises a second end face opposite to the first end face;
the plurality of heat generating members are disposed on the second end face; and
the first electrode disposed on the first main surface, the first end face, the second main surface, and the second end face.

6. The thermal head according to claim 5, wherein the first electrode is disposed on substantially an entire area of the first end face and the second main surface.

7. The thermal head according to claim 3, wherein the first electrode comprises:
an extending portion that extends along an edge of the first end face of the first main surface; and
a first protruding portion that protrudes at the extending part from a side of the first end face toward a side of the second electrode, and that is surrounded by the second electrode.

8. The thermal head according to claim 7, wherein
the second electrode comprises a plurality of second protruding portions adjacent to the first protruding portion; and
a width of the first protruding portion and widths of the second protruding portions are substantially same.

9. The thermal head according to claim 7, further comprising:
a temperature measuring electrode on the first main surface; and
a temperature measuring member on the temperature measuring electrode, measuring a temperature of the heat generating member,
wherein the first protruding portion protrudes toward the temperature measuring member.

10. The thermal head according to claim 9, wherein the first protruding portion extends to a region below the temperature measuring member.

11. A thermal printer comprising:
the thermal head according to claim 1;
a conveying device that conveys a recoding medium on the heat generating members; and
a platen roller that presses the recording medium against the heat generating members.

* * * * *